US005182580A

United States Patent [19]

Ikeda et al.

[11] Patent Number: 5,182,580

[45] Date of Patent: Jan. 26, 1993

[54] INK JET RECORDING APPARATUS WITH ABNORMAL STATE DETECTION

[75] Inventors: Kazue Ikeda, Yokohama; Toshihiko Ujita, Yamato, both of Japan

[73] Assignee: Canon Kabushiki Kaisha, Tokyo, Japan

[21] Appl. No.: 660,869

[22] Filed: Feb. 26, 1991

[30] Foreign Application Priority Data

| | | | |
|---|---|---|---|
| Feb. 26, 1990 | [JP] | Japan | 2-42531 |
| Feb. 26, 1990 | [JP] | Japan | 2-42532 |
| Feb. 25, 1991 | [JP] | Japan | 3-30114 |

[51] Int. Cl.[5] ..... B41J 2/01; B41J 2/165

[52] U.S. Cl. ..... 346/140 R

[58] Field of Search ..... 346/140 R

[56] References Cited

U.S. PATENT DOCUMENTS

| | | | |
|---|---|---|---|
| 3,771,568 | 11/1973 | Bischoff | 346/140 X |
| 4,313,124 | 1/1982 | Hara . | |
| 4,313,684 | 2/1982 | Tazaki | 346/410 X |
| 4,345,262 | 8/1982 | Shirato et al. . | |
| 4,459,600 | 7/1984 | Sato et al. . | |
| 4,463,359 | 7/1984 | Ayata et al. . | |
| 4,489,335 | 12/1984 | Watanabe | 346/140 |
| 4,550,327 | 10/1985 | Miyakawa | 346/140 |
| 4,558,332 | 12/1985 | Takahashi . | |
| 4,558,333 | 12/1985 | Sugitani et al. . | |
| 4,577,203 | 3/1986 | Kawamura . | |
| 4,625,220 | 11/1986 | Nagashima . | |
| 4,723,129 | 2/1988 | Endo et al. . | |
| 4,740,796 | 4/1988 | Endo et al. . | |
| 4,813,802 | 3/1989 | Gilham et al. . | |
| 4,996,487 | 2/1991 | McSparran | 346/140 X |

FOREIGN PATENT DOCUMENTS

| | | |
|---|---|---|
| 54-51837 | 4/1979 | Japan . |
| 54-56847 | 5/1979 | Japan . |
| 55-074890 | 6/1980 | Japan . |
| 55-095184 | 7/1980 | Japan . |
| 57-128558 | 8/1982 | Japan . |
| 59-14967 | 1/1984 | Japan . |
| 59-123670 | 7/1984 | Japan . |
| 59-138461 | 8/1984 | Japan . |
| 60-71260 | 4/1985 | Japan . |
| 61-98542 | 5/1986 | Japan . |
| 1-120351 | 5/1989 | Japan . |
| 2210586 | 6/1989 | United Kingdom . |

OTHER PUBLICATIONS

T. Ikoma, IBM Technical Disclosure Bulletin, vol. 24, No. 3, "Method to Detect 'In Situ' Defects in Nozzles in Ink Jet Printers", p. 1585, Aug. 1981.

*Primary Examiner*—Joseph W. Hartary

[57] ABSTRACT

An ink jet recording apparatus records information by ejecting ink droplets onto a recording medium. The ink jet recording apparatus has a recording head; driving circuits, measuring circuit, and a judging unit. The recording head has ejection outlets and ink liquid passages connecting to the ejection outlets respectively, an electron-thermal converting element being disposed in each of the ink liquid passages, for generating thermal energy for ejecting the ink droplets. The driving circuits drive the electro-thermal converting element to generate the thermal energy enough to eject the ink droplet. The measuring circuit individually measures a resistance value of the electro-thermal converting element when the driving circuits drive the electro-thermal converting element. The judging unit judges presence of an abnormal state in the ink liquid passage according to the resistance value.

7 Claims, 23 Drawing Sheets

INK JET RECORDING APPARATUS WITH ABNORMAL STATE DETECTION

BACKGROUND OF THE INVENTION

1. Field of the Invention

The present invention relates to an ink jet recording apparatus used for recording information in the form of visual images and symbolic characters by means of ejecting ink droplets onto a recording medium such as paper sheets and so on.

2. Description of the Prior Art

An ink jet recording apparatus has several advantages. For instance, the level of noise generated by recording operations could be kept so low as to be neglible and common paper sheets can be used without processing and/or coating specific synthetic materials on the paper surfaces. There exist various kinds of ink jet ejecting methods used in the ink jet recording apparatus and in recent years, some of these methods have been put into practical uses.

Among these kinds of ink jet ejecting methods. one ink jet ejecting method, for instance, as described in Japanese Patent Application Laying-Open No. 51837/1979 has a different feature from that of other kinds of ink jet ejecting methods in that kinetic energy for ejecting ink droplets is obtained by means of transferring thermal energy into ink. In this ink jet ejecting method, a rapid voluminous change occurs in ink in accordance with a state transition of the ink caused by the thermal energy so that an ink droplet is ejected from an ejection outlet formed at the front of a recording head to form a flying ink droplet. The flying droplet reaches the surface of the recording medium and thus information recording can be established.

A recording head used in the above described ink ejecting methods, in general, has the ink ejection outlet for ejecting ink droplets and an ink liquid passage which communicates with the ink ejection outlet and which includes a heat process portion for transferring the thermal energy to ink so as to eject ink droplets from the ink ejection outlet. The heat process portion of the ink liquid passage has an electro-thermal coverting element for generating the thermal energy. The electro-thermal converting element has a resistance layer for heating and at least one pair of electrodes connected to the resistance layer. The resistance layer generates heat between said two electrodes by means of applying a voltage between said two electrodes. In this kind of a recording head, in general, forces applied into the ink of the ink liquid passage which are induced by capillary action, pressure drops or the like, are balanced so that a meniscus is formed in the ink liquid passage at the neighborhood of the ink ejection outlet. Every time an ink droplet is ejected, by means of the above mentioned balanced forces applied into ink, ink is supplied continuously into the ink liquid passage and a meniscus is formed again in the ink liquid passage at the neighborhood of the ink ejection outlet.

In the recording head with its structure described above, a few disadvantages exist.

The first disadvantages can be stated as follows. In order to make an ink ejection action stable, the pressure of ink contained in the ink liquid passage and other portions of the recording head should be kept in an appropriate value. In order to do so, various kinds of arrangements related to the recording head have been proposed. For example, the recording head and an ink tank for preserving ink which is connected to the recording head through a tube or the like are arranged in such a manner that their relative positions there between in a vertical direction are appropriately determined so that the pressure in the ink liquid passage may be kept in an appropriate value. However, in case that a shock is given to the recording head during transport of the recording apparatus or in case that a pressure fluctuation occurs in the inside of a cap while an ink ejection-outlet-disposed surface of the recording head is capped with the cap for preventing the evaporation of ink, the meniscus is moving downward from the neighborhood of the ink ejection outlet to the inside of the ink liquid passage due to a force generated by the shock and the pressure fluctuation applied to the ink. This phenomena is known as a loss of ink feed. In the loss of ink feed, the ink droplet can not be ejected regularly. Furthermore, in case of trying to continue to transfer thermal energy generated by the electro-thermal converting element into an empty portion of the ink liquid passage where ink is lost, the electro-thermal converting element may be even damaged due to heat concentration.

The second disadvantage relates to an increase of viscosity of ink. That is, in case that a viscosity of ink in the ink liquid passage is increased due to the evaporation of solvent components of ink through the ink ejection outlet of the recording head and so on, an ink ejection failure such as a decrease of the amount of the ejected ink droplet or non-election of ink occurs. Although an increase of viscosity of ink could be avoided to a certain extent by way of the capping as described earlier, such a way may not cope with this problem especially in case of trying ink ejection after a long period of time during which the ink ejection has not been performed.

The third disadvantage directs to bubbles generated in the ink. Small-sized bubbles in the ink generated by heat unused for ejecting ink droplets and bubbles mixed into ink from outside of the recording head through an ink supply passage member such as a tube may enlarge over a long period of time. In case that the enlarged bubbles exist in the ink liquid passage, there may occur the ink ejection failure such as a deflection of ejected ink droplet and the decrease of the amount of ejected ink droplet.

For resolving or preventing the first, second and third disadvantages described above, in some ink jet recording apparatuses, ejection recovery operations of the recording head or the like are performed. As for the ejection recovery operation, one approach is a suction method where ink in the ink liquid passage and other portions of the recording head is sucked to be discharged from the ink ejection outlet using a sucker pump and the other approach is an idle ejection method where the ink ejection is performed, independent of scheduled services of ink jet recording operations. A pressurizing method, similar to the suction method, is another approach where ink contained in the recording head is pressurized by pressure in the side of an ink supply passage to be discharged outside from the ink ejection outlet.

By means of the above mentioned suction method, pressurizing method or idle ejection method, high viscosity ink and the bubble growing in ink can be eliminated and also, by these ejection recovery operations which generate a force acting on ink contained in the recording head, the meniscus is returned to its regular position in the ink liquid passage so that the loss of ink feed can be overcome.

The ejection recovery operations described above or the like are done properly when an electric power source to the recording apparatus is put on or the recording operations of the recording apparatus begins. However, at the time when the ejection recovery operations or the like are done, it is not necessarily found that an abnormal state in the ink liquid passage and other portions of the recording head such as the loss of ink feed and the increase of viscosity of ink mentioned above occur. In case of doing such unnecessary ejection recovery operations or the like, ink is used wastefully as well as the recording efficiency goes down due to wasting time for doing such recovery operation.

With respect to overcoming the above mentioned drawbacks in applying the ejection recovery operations, for example, as found in Japanese Patent Application Laying-Open No. 98542/1986, disclosed is a structure for detecting temperature of the recording head and for knowing a presence of the abnormal state based on the detected temperature. In this prior art structure, it is possible to execute the ejecting recovery operation, only when the abnormal state is found in the ink liquid passage and so on. However, the detection of abnormality is not directed to individual parts of a plurality of the ink liquid passages. In case that the abnormal state exists in a relatively small number of the ink liquid passages among all of them, the temperature change which occurs in the overall recording head by above mentioned small abnormal state is hard to be detected, therefore, it is difficult that the abnormal state is detected.

With respect to overcoming the above mentioned problem in abnormality detection which should be resolved, for example, a structure disclosed in Japanese Patent Application Laying-Open No. 14967/1984 can be taken to be one approach to the solution. In the disclosed structure, by means of supplying the electric energy into the electro-thermal converting element for generating thermal energy for ejecting ink droplet, this electric energy being not enough to make ink drops ejected, temperature change is caused. And the abnormal state in the ink liquid passage is examined by detecting fluctuation of the electric energy being supplied into the electro-thermal converting element which is adversely caused by the above mentioned temperature change. In this structure for detecting the abnormal state, the abnormal state in the individual ink liquid passage can be detected separately by sensing up the electric current through the individual electro-thermal converting element.

However, because the above additive electric energy supplied to the electro-thermal converting element for detecting the abnormal state is taken to be low enough so that the energy may not contribute to ink droplet ejection, it takes a relatively longer time to detect a significant change in the electric energy induced by the temperature change caused by the additive electric energy. So far, it takes a longer time to detect the abnormal state, and because a number of fine-sized bubbles are generated by heat generated in ink while the electric energy is supplied continuously into the electro-thermal converting element for a relatively long time, these fine-sized bubbles may exert a bad influence on the ink droplet ejection. In addition, because detection procedures of the abnormal state are made independently of the ejection recovery operations, an occurrence of time spent for the detection procedures brings a lowering of efficiency of the overall recording procedures. And furthermore, a specific structure is required to supply the additive electric energy as low as the ink droplet ejection never occurs.

SUMMARY OF THE INVENTION

An object of the present invention is to provide an ink jet recording apparatus for enabling to execute appropriate ejection recovery operations by means of examining a presence of the abnormal state in the ink liquid passage and other portions by supplying an electric energy into the electro-thermal converting element for ejecting and ink droplet and by detecting a predetermined state of the electro-thermal converting element caused by the supply of the electric energy.

In the first aspect of the present invention, an ink jet recording apparatus for recording information by ejecting ink droplets onto a recording medium comprises:

a recording head having a plurality of ejection outlets for ejecting plurality of ink droplets and having a plurality of ink liquid passages, the ink liquid passages connecting to the plurality of ejection outlets respectively, an electro-thermal converting element being disposed in each of the plurality of ink liquid passages, for generating thermal energy for ejecting the ink droplets;

driving means for driving the electro-thermal converting elements of the recording head to generate the thermal energy;

detecting means for individually detecting a designated state change occurring in the electro-thermal converting element or in each of the plurality of ink liquid passages when the driving means drive the electro-thermal converting, elements; and judging means for judging presence of an abnormal state in each of the plurality of ink liquid passages according to the state change detected by the detecting means.

In the second aspect of the present invention, an ink jet recording apparatus for recording information by ejecting ink droplets onto a recording medium comprises:

a recording head having a plurality of ejection outlets for ejecting a plurality of ink droplets and having a plurality of ink liquid passages, the ink liquid passages connecting to the plurality of ejection outlets respectively, an electro-thermal converting element being disposed in each of the plurality of ink liquid passages, for generating thermal energy for ejecting the ink droplets;

driving means for driving the electro-thermal converting elements of the recording head to generate the thermal energy enough to eject the ink droplet;

measuring means for individually measuring a resistance value of the electro-thermal converting element when the driving means drive the electro-thermal converting element; and judging means for judging presence of an abnormal state in the ink liquid passage according to the resistance value measured by said measuring means.

In the third aspect of the present invention, an ink jet recording apparatus for recording information by ejecting ink droplets onto a recording medium comprises:

a recording head having a plurality of ejection outlets for ejecting a plurality of ink droplets and having a plurality of ink liquid passages, the ink liquid passages connecting to the plurality of ejection outlets respectively, an electro-thermal converting element being disposed in each of the plurality of ink liquid passages, for generating thermal energy for ejecting the ink droplets;

driving means for driving the electro-thermal converting elements of the recording head to generate the thermal energy enough to eject the ink droplet;

measuring means for individually measuring a resistance value of the electro-thermal converting elements when the driving means drive the electro-thermal converting elements;

judging means for judging presence of an abnormal state in the ink liquid passage according to the resistance value measured by the measuring means; and ejection recovery means for discharging ink from the ink liquid passage when the judging means judges a presence of the abnormal state.

In the fourth aspect of the present invention, an ink jet recording apparatus for recording information by ejecting ink droplets onto a recording medium comprises:

a recording head having a plurality of ejection outlets for ejecting a plurality of ink droplets and having a plurality of ink liquid passages, the ink liquid passages connecting to the plurality of ejection outlets respectively, an electro-thermal converting element being disposed in each of the plurality of ink liquid passages, for generating thermal energy for ejecting the ink droplets;

driving means for driving the electro-thermal converting elements of the recording head to generate the thermal energy;

sound-wave detecting a means for detecting sound wave, the sound-wave detecting means being disposed in the neighborhood of the recording head; and judging means for judging presence of an abnormal state in the ink liquid passage according to the sound-wave detected by the sound-wave detecting means when the drives means driving the electro-thermal converting element.

The above and other objects, effects, features and advantages of the present invention will become more apparent from the following description of embodiments thereof taken in conjunction with the accompanying drawings.

BRIEF DESCRIPTION OF THE DRAWINGS

Embodiments of the invention will now be described, by way of example and with reference to the accompanying drawings in which like parts are designated with like numerals throughout, and in which.

Figure 3:
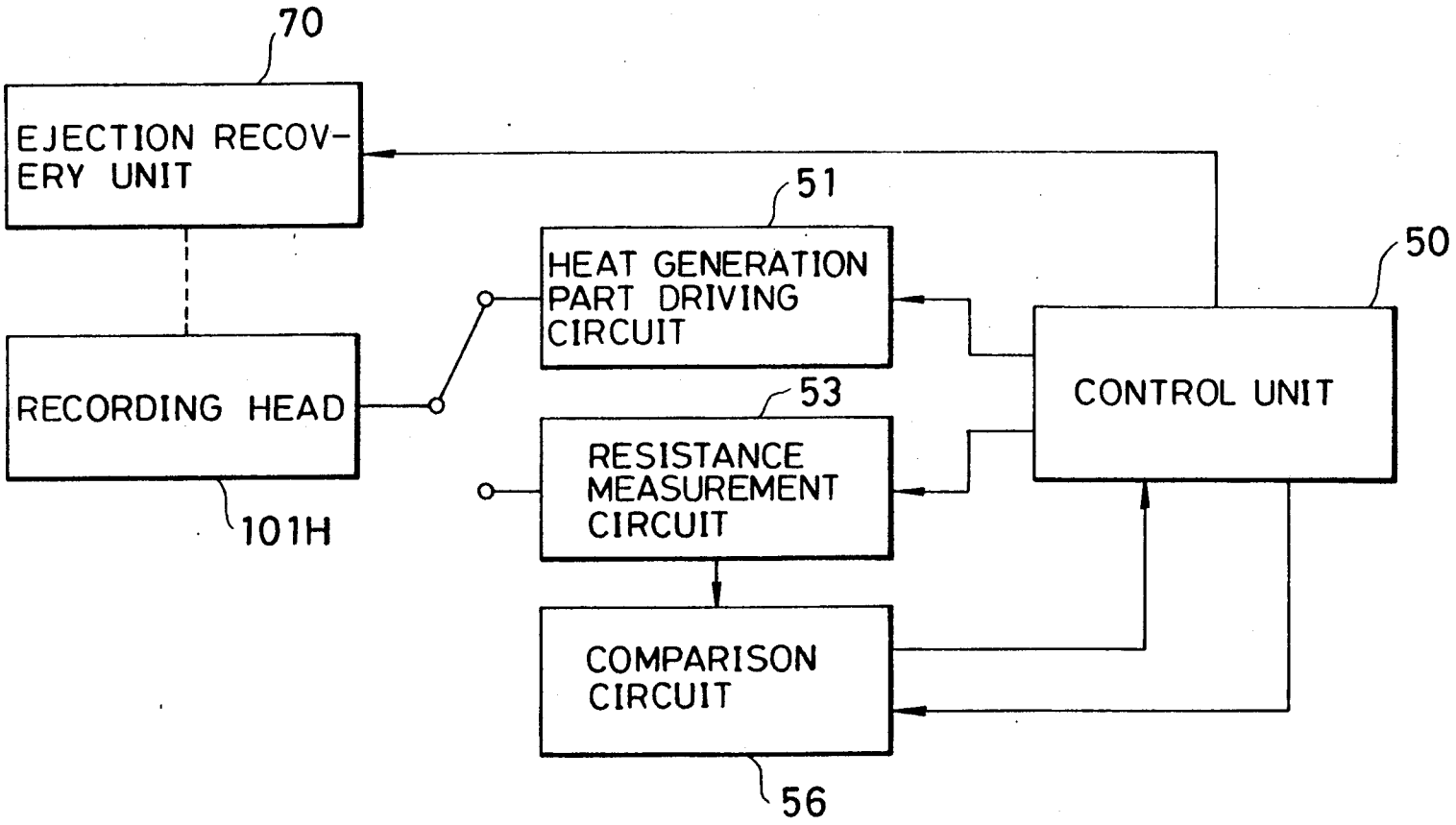
FIG. 3 is a block diagram illustrating an example of a major part of a control system in the ink jet recording apparatus.
Figure 5:
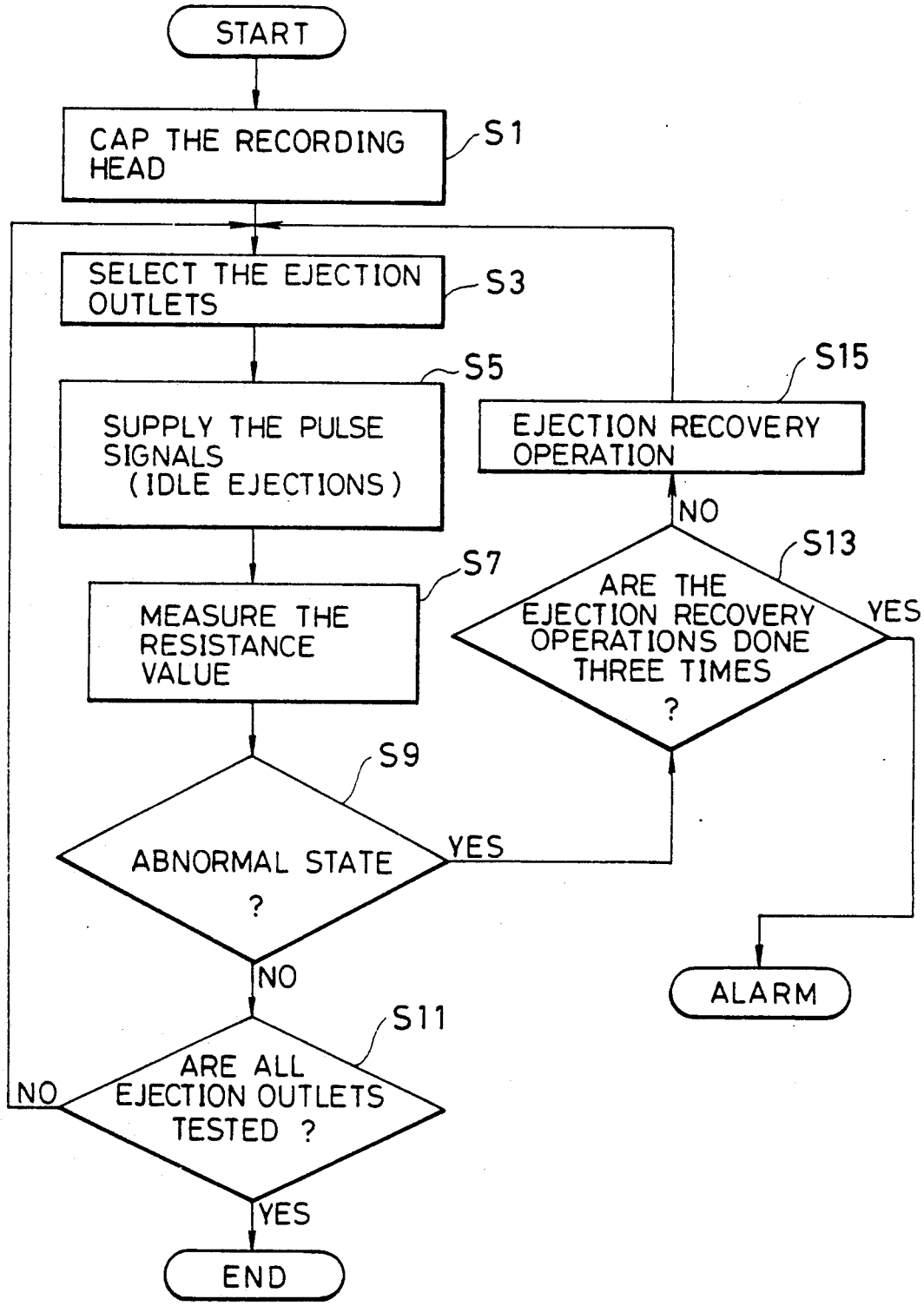
Figure 6:
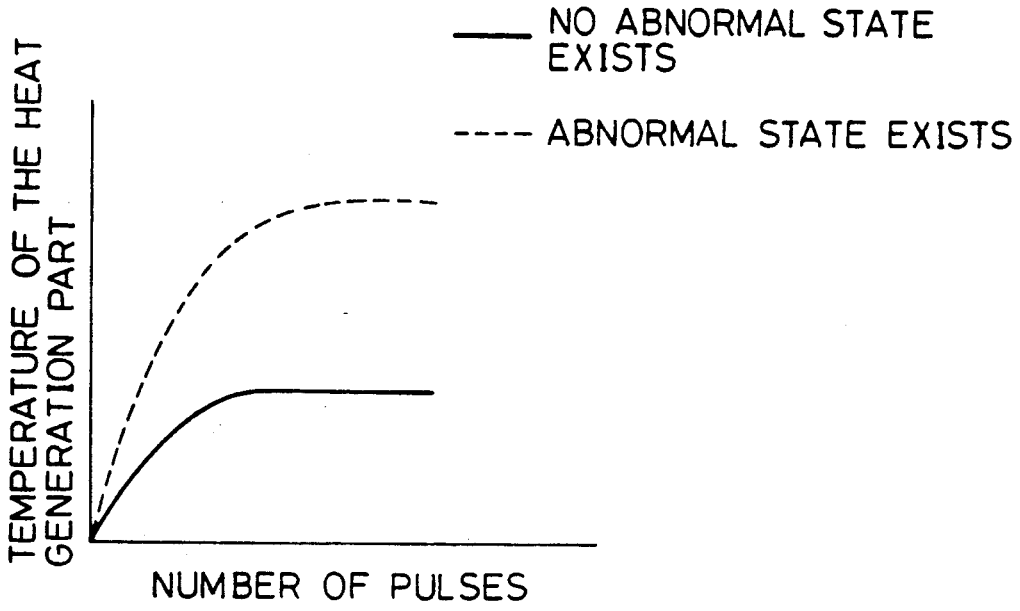
Figure 7A:
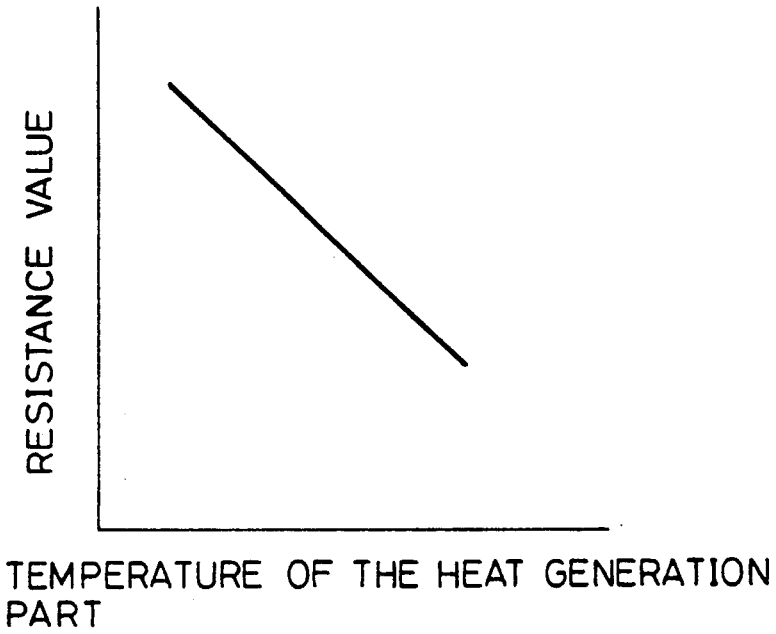
Figure 7B:
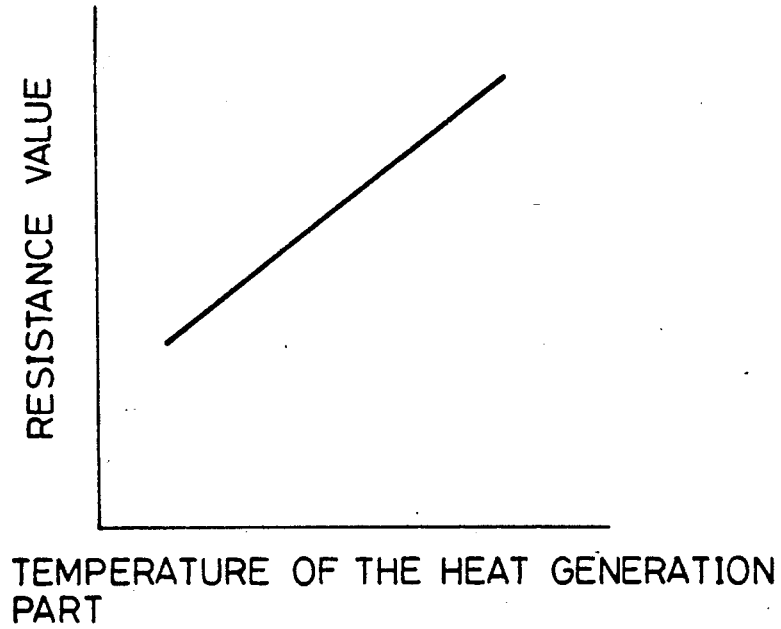
Figure 8A:
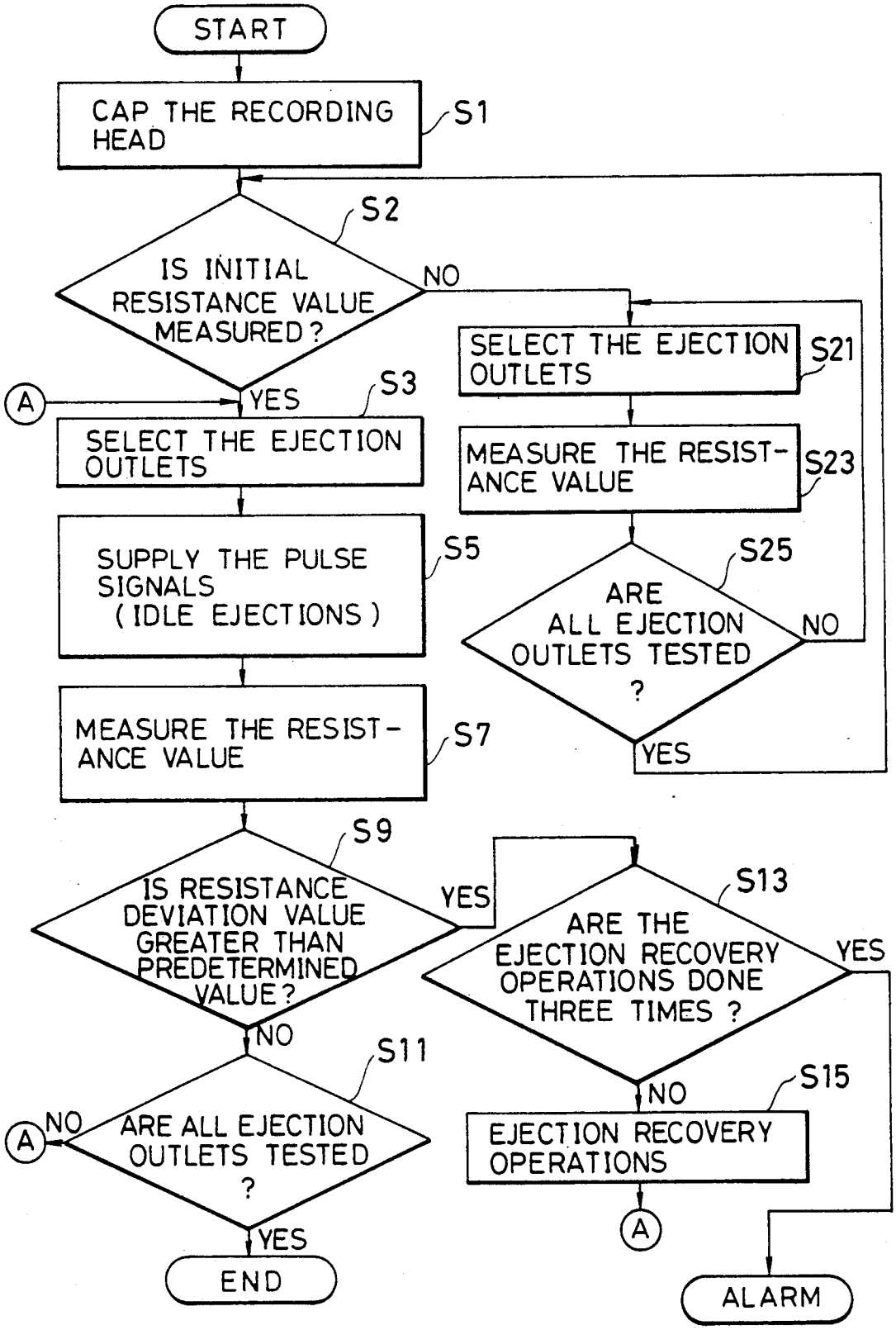
Figure 8B:
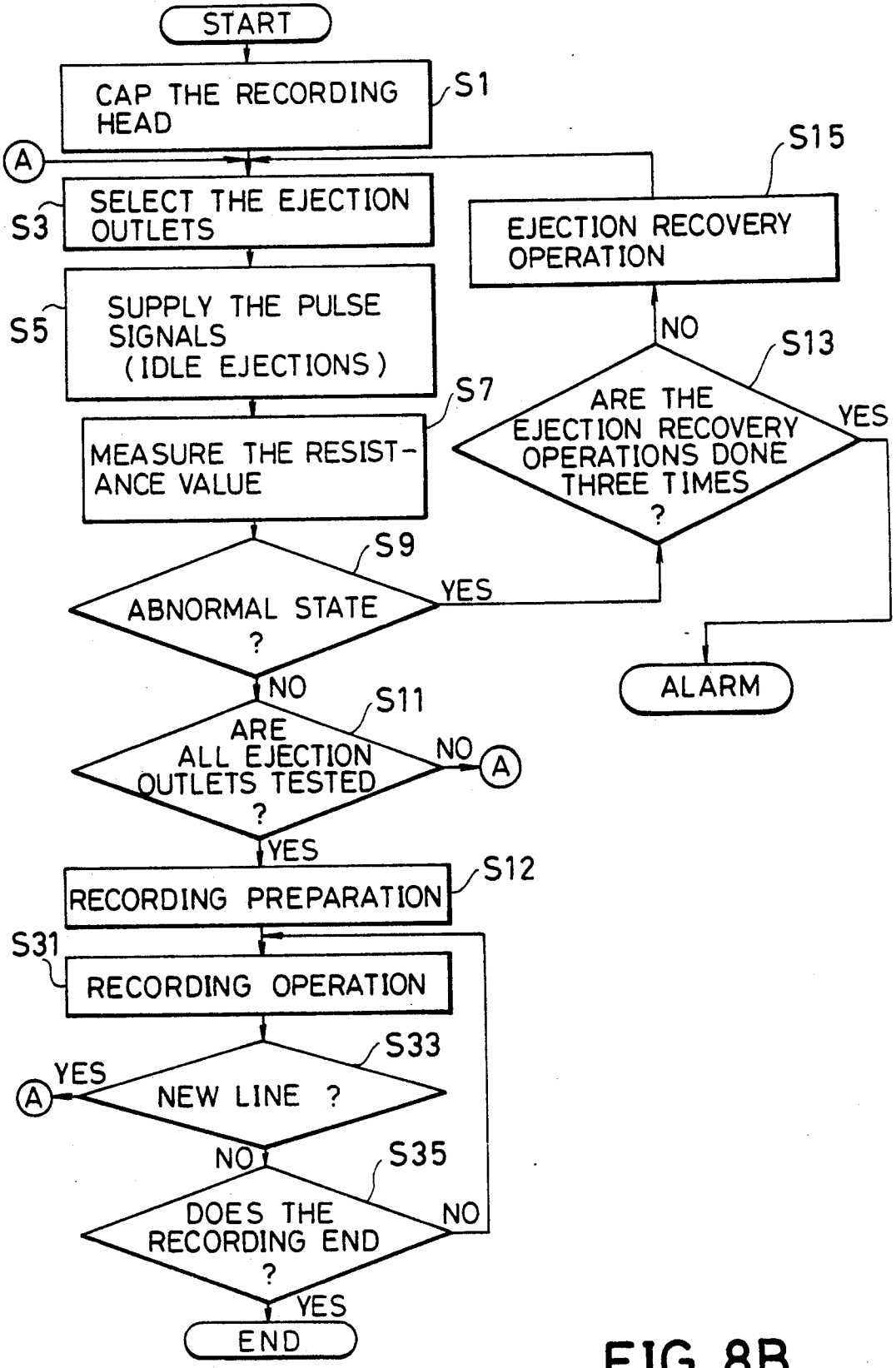
Figure 9A:
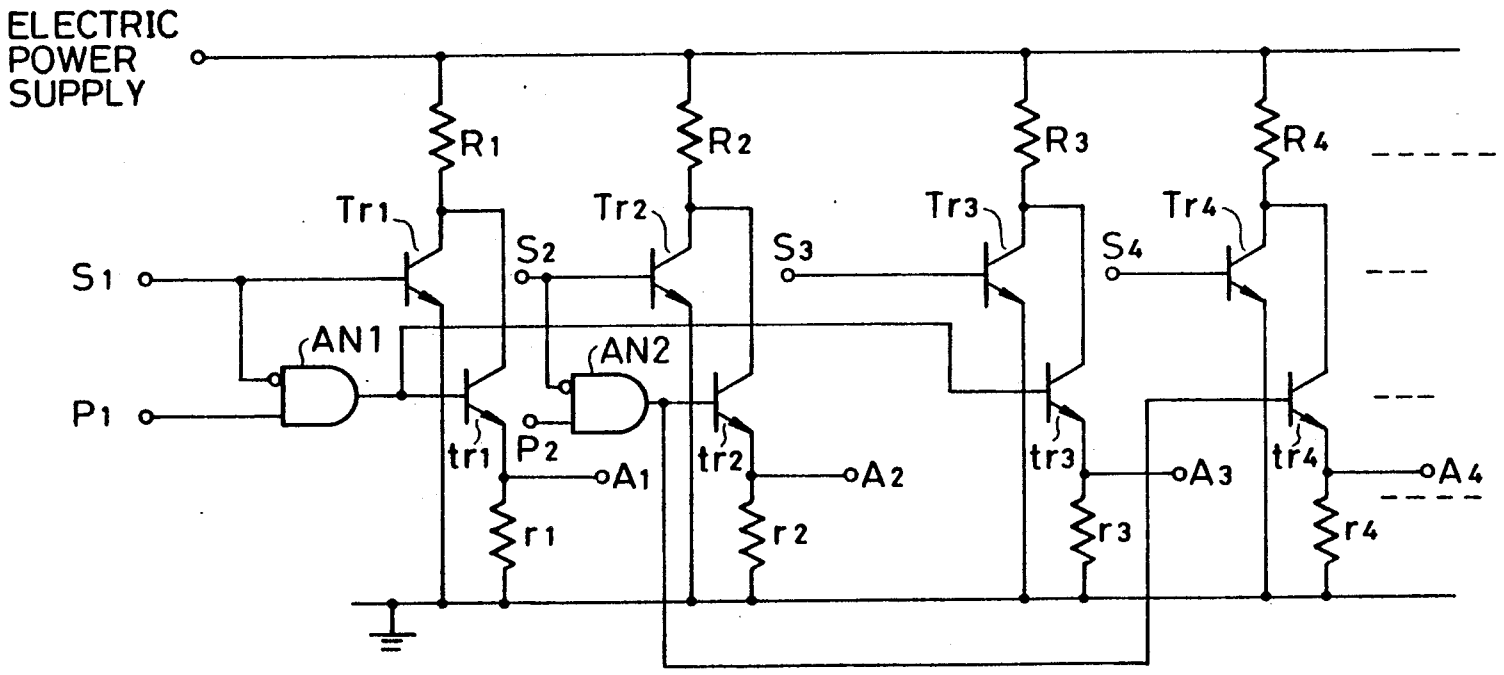
Figure 9B:
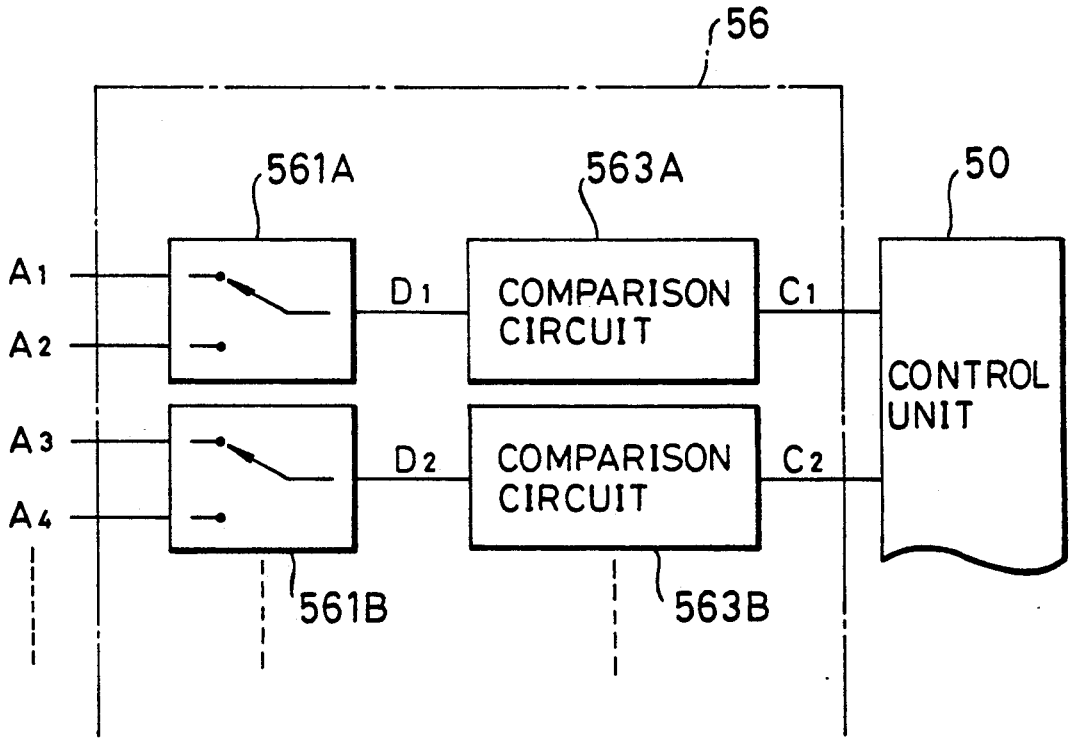
Figure 9C:
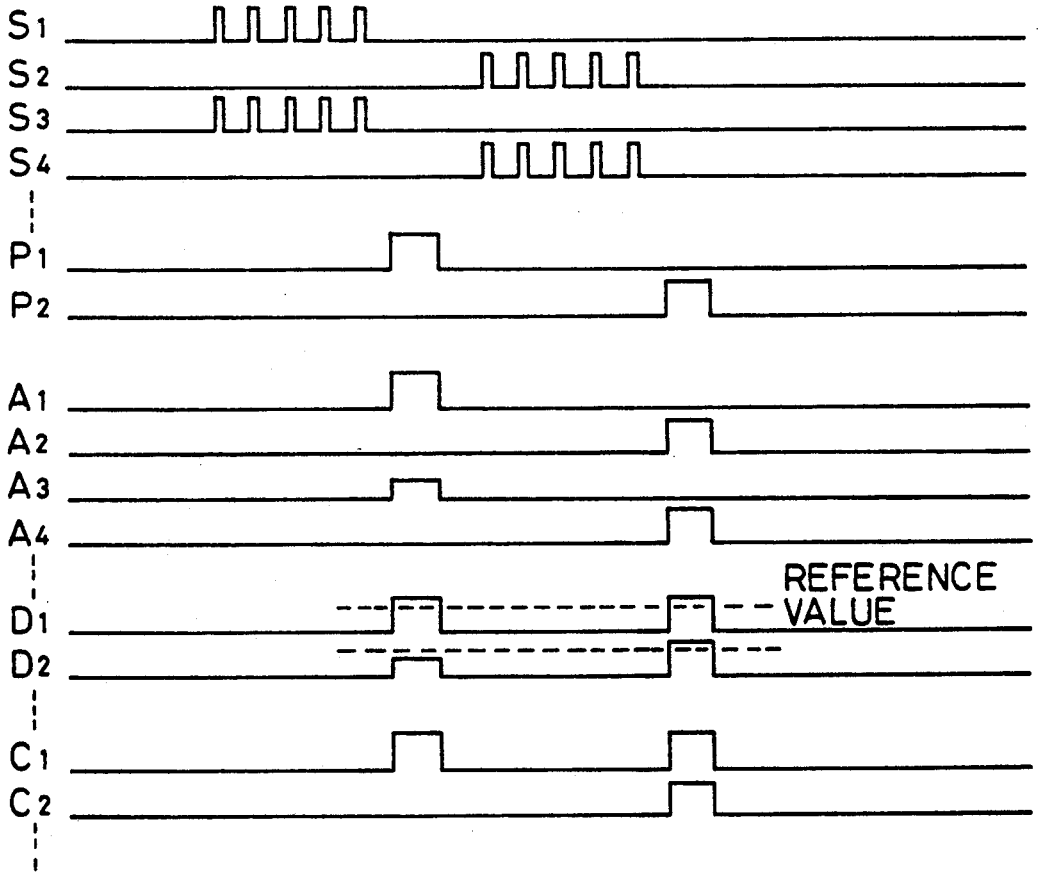
Figure 10A:
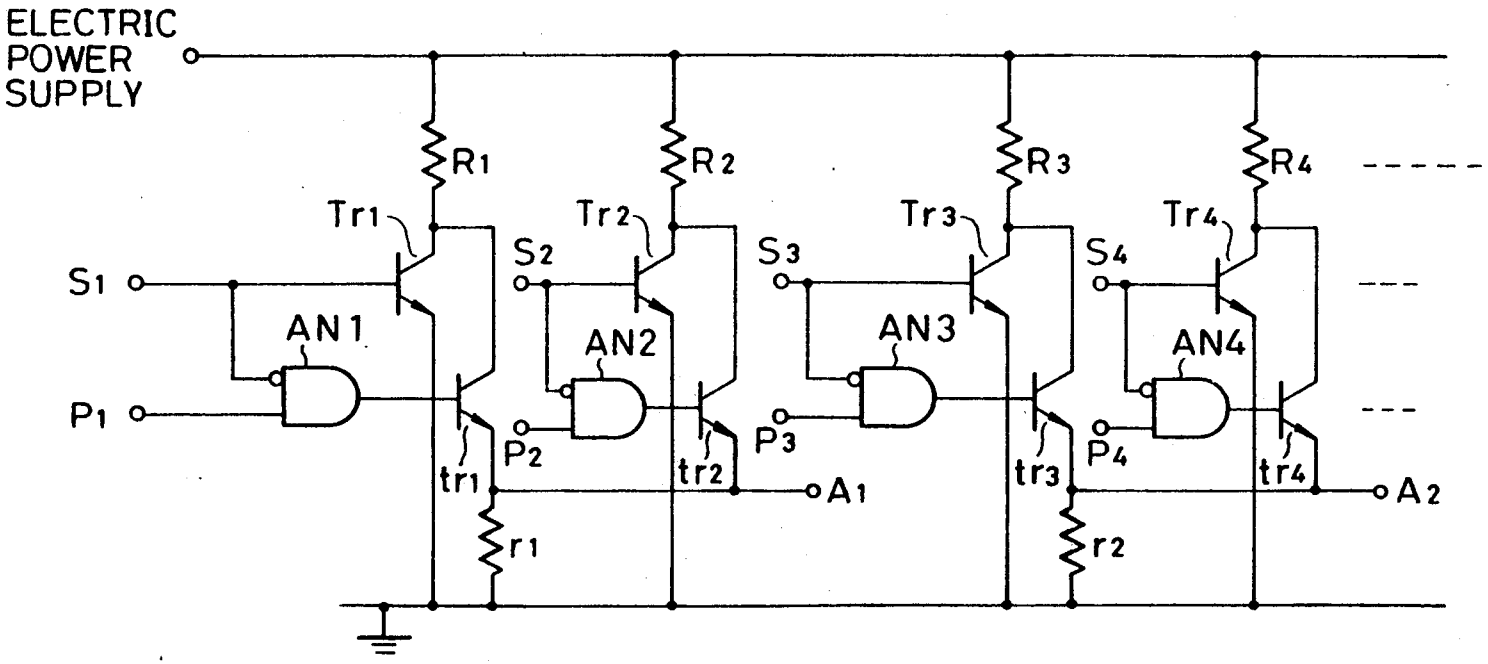
Figure 10B:
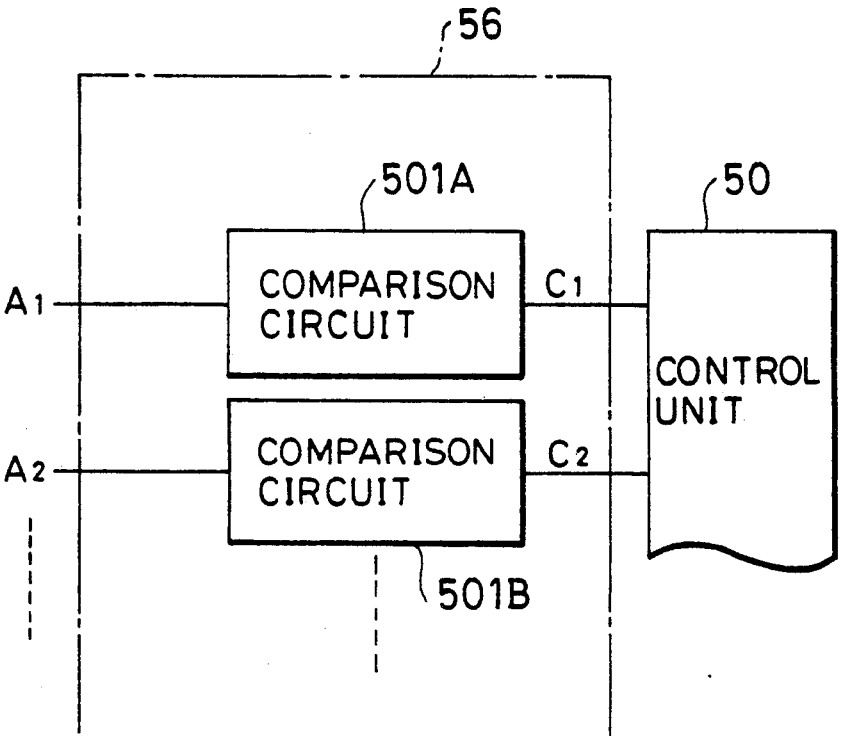
Figure 10C:
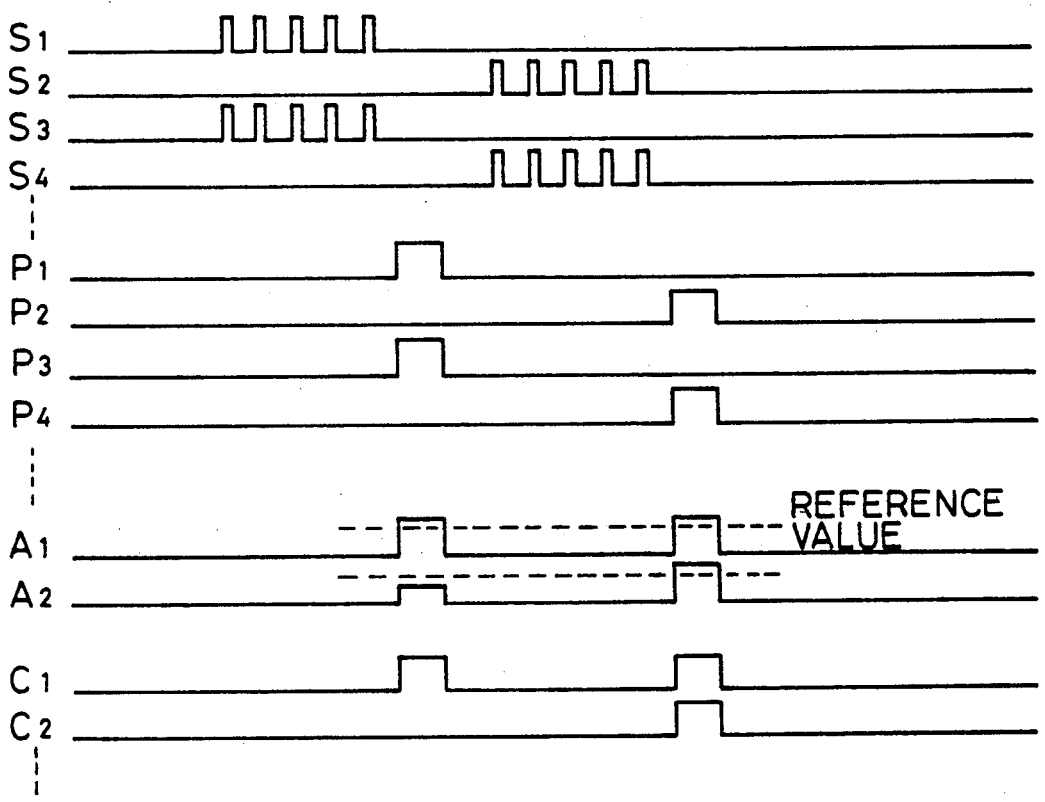
Figure 11:
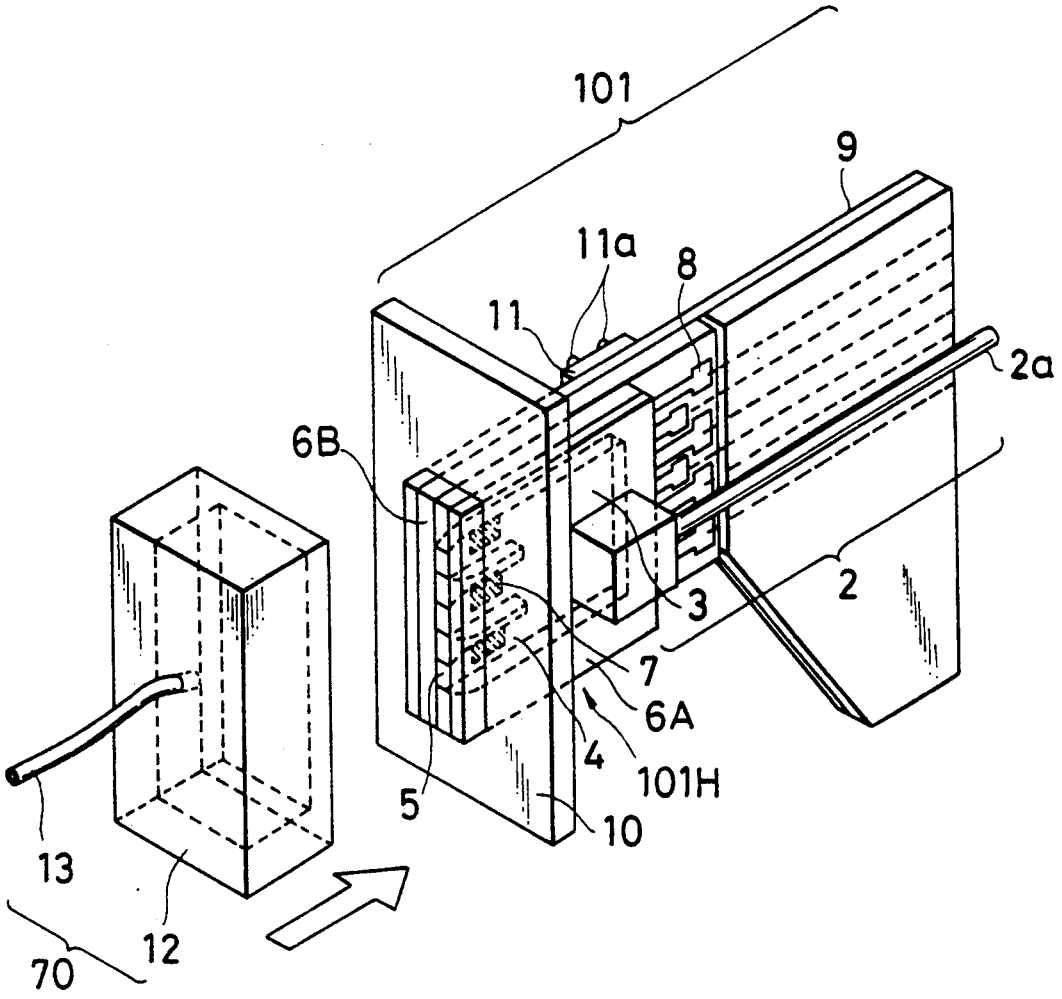
Figure 12:
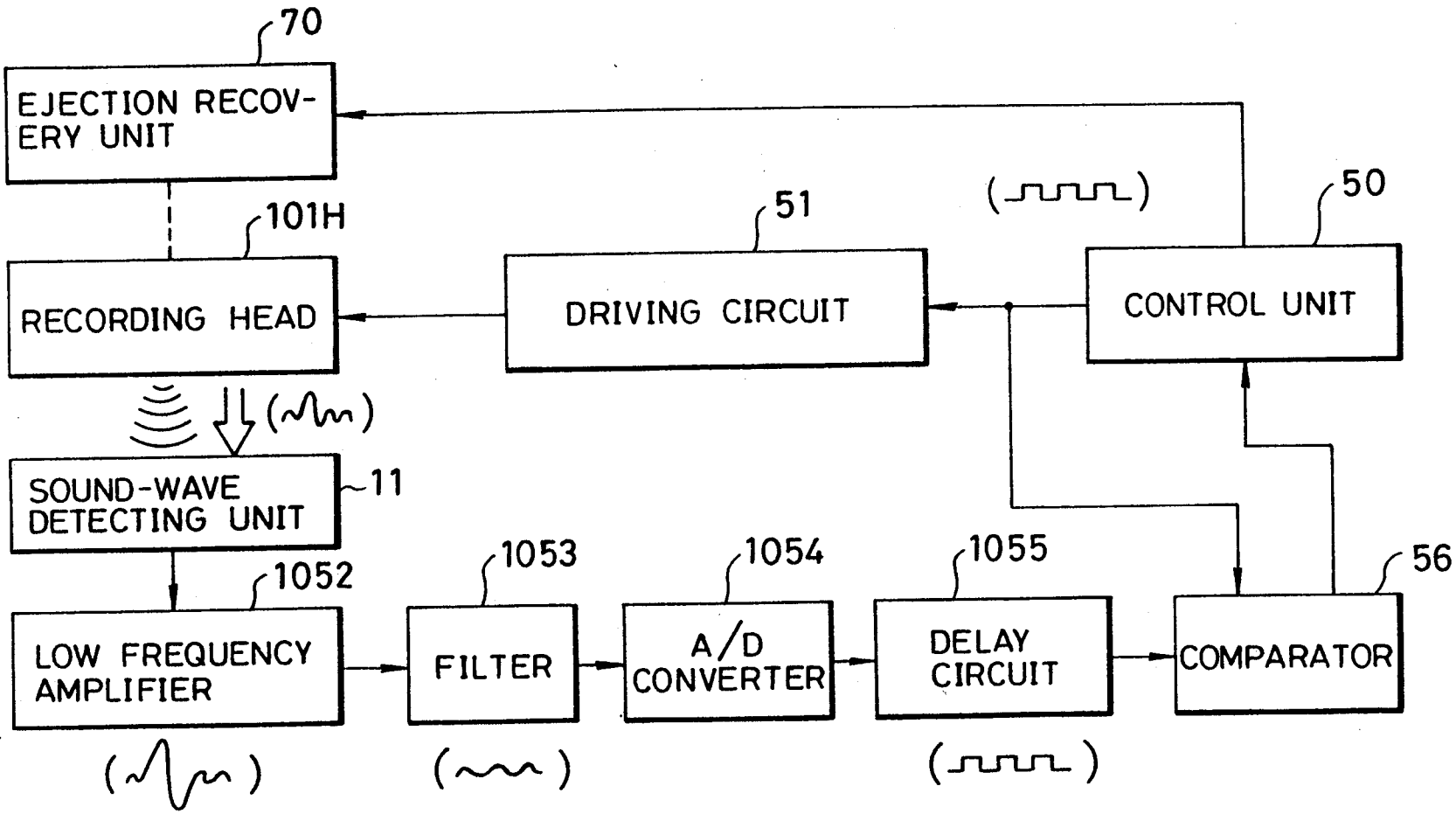
Figure 13:
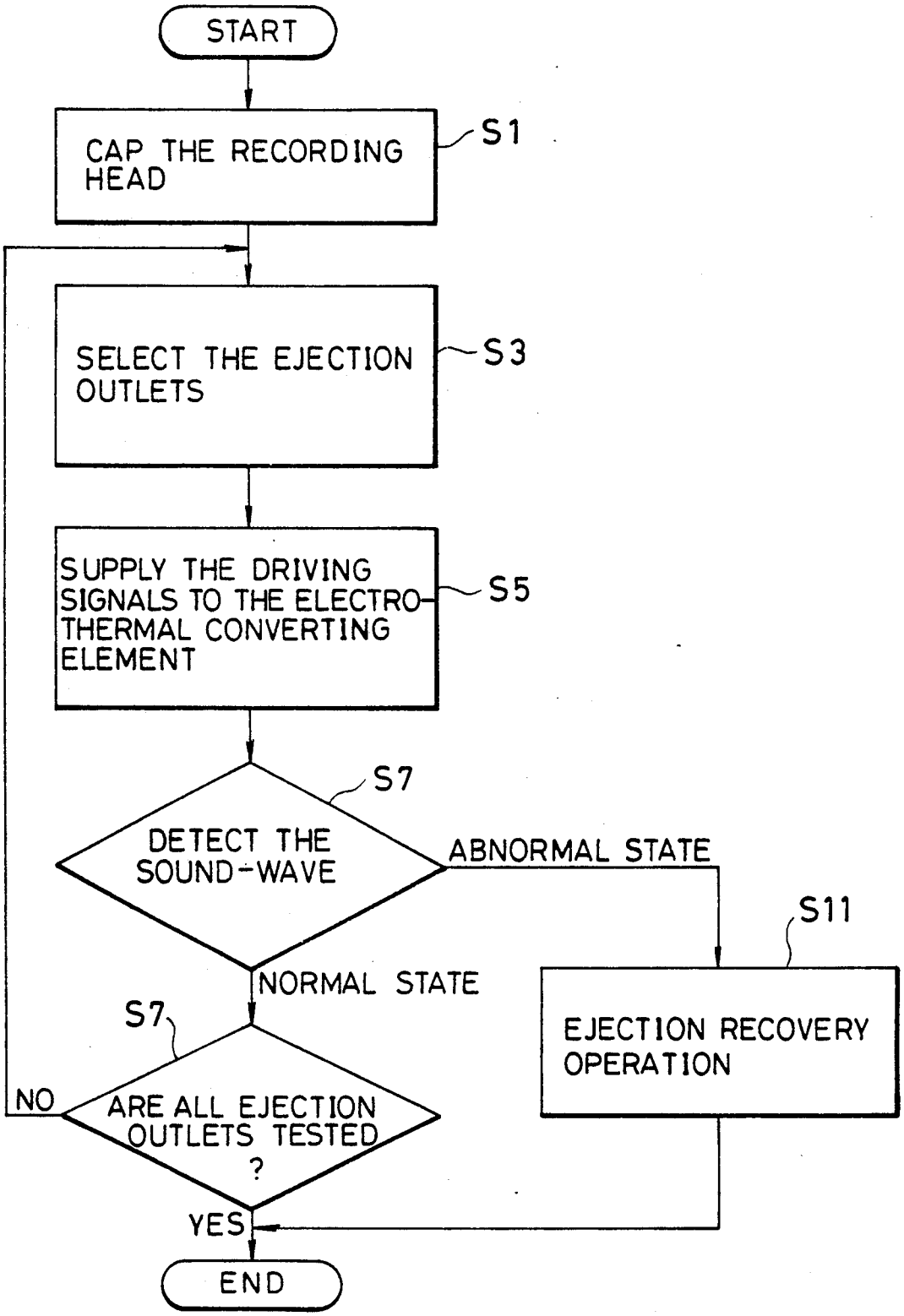
Figure 14:
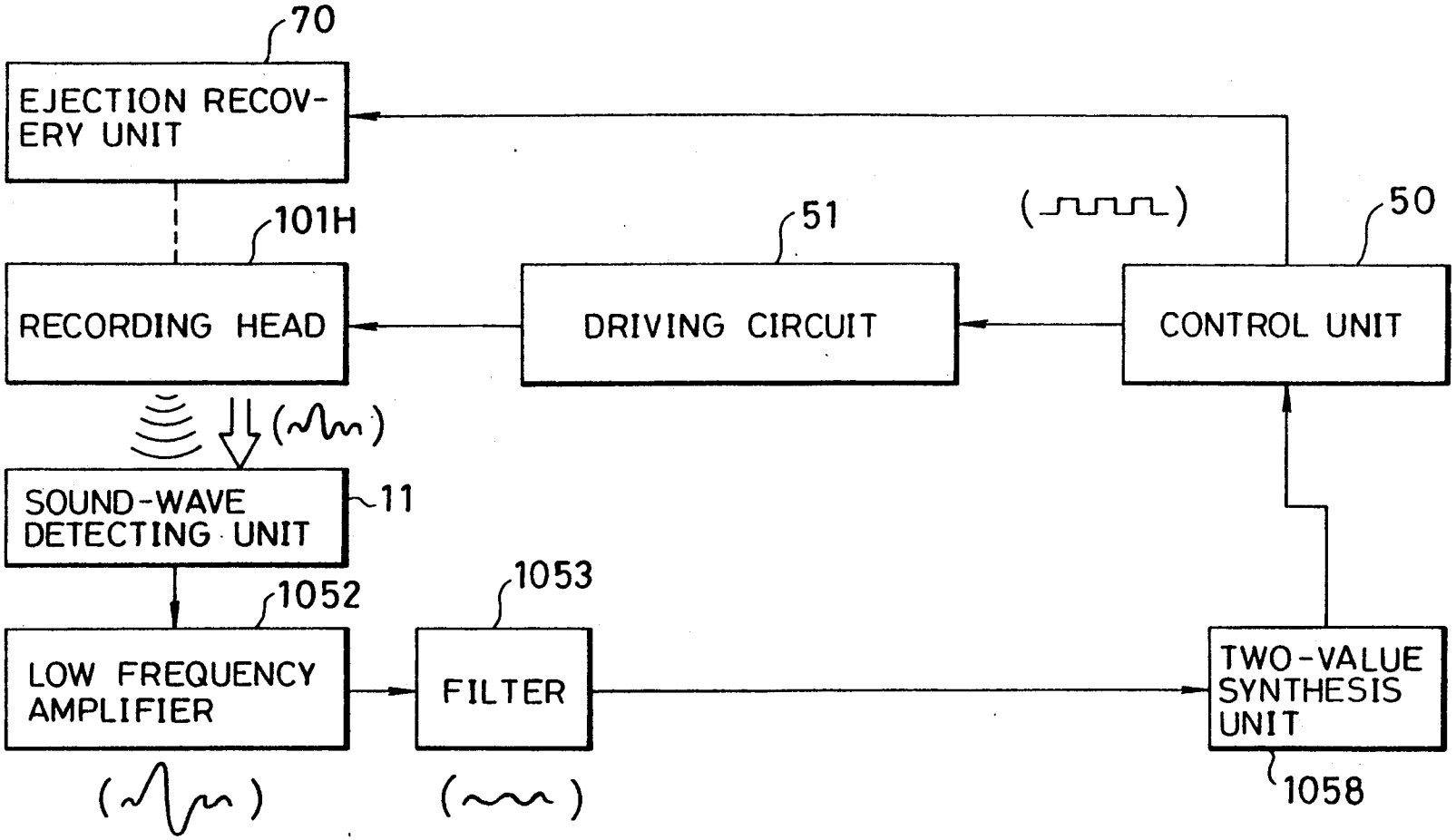
Figure 15:
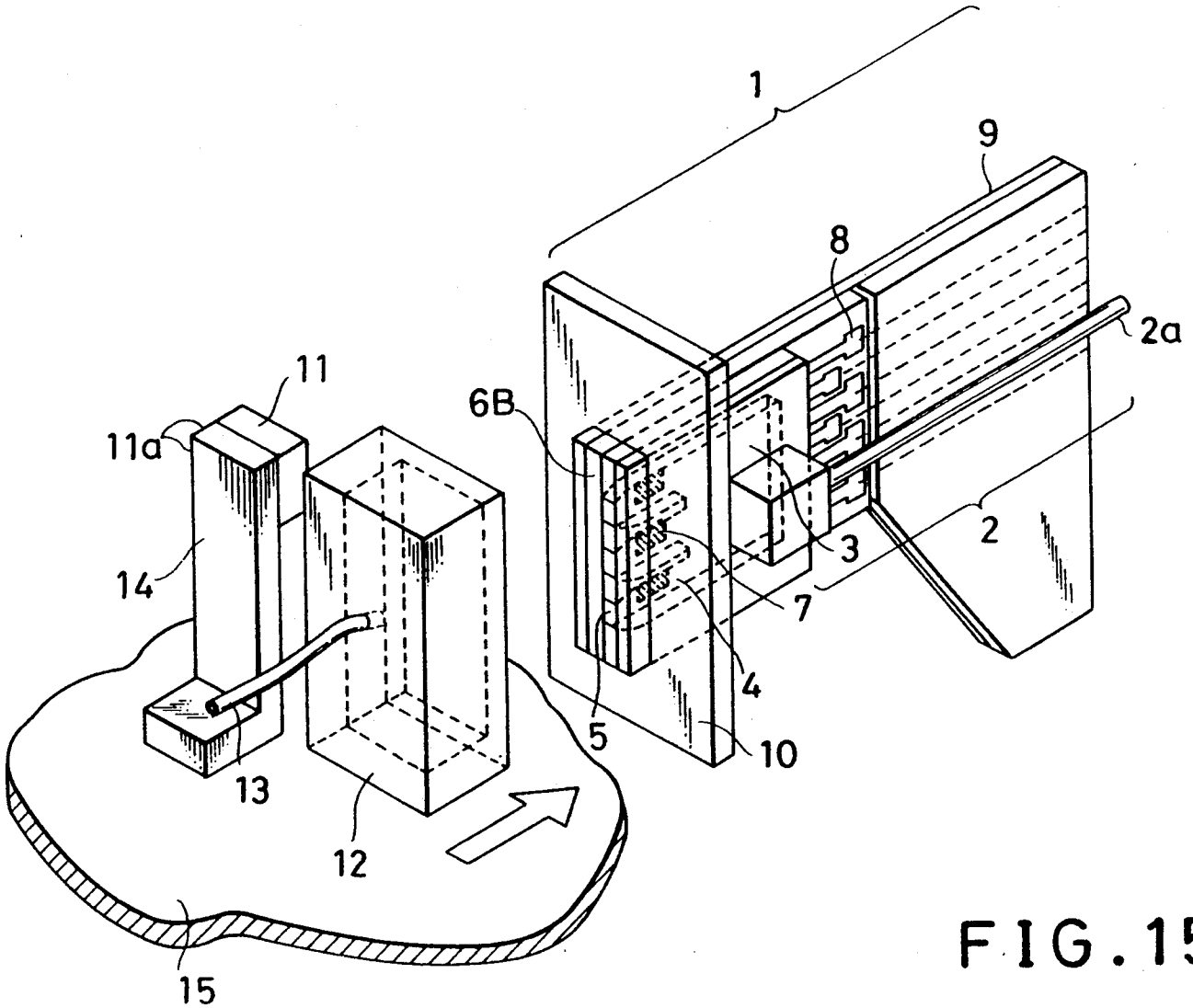

FIG, 4C is a timing chart of signals shown in FIGS, 4A and 4B;

FIG. 5 is a flow chart illustrating an example of procedures in the control system shown in FIG. 3;

FIG. 6 is a graph illustrating temperature change in the heat generation part when a driving signal is supplied into the heat generation part shown in FIG. 3;

FIGS. 7A and 7B are graphs representing two examples of the relationship between the temperature of the heat generation part and the resistance of a electron-thermal converting element;

FIGS. 8A and 8B are flow charts of procedures in other two embodiments of the present invention;

FIGS. 9A and 10A are circuit diagrams illustrating two other embodiments of the heat generation part driving circuit and a resistance measurement circuit, both circuits shown in FIG. 3;

FIGS. 9B and 10B are block diagrams of a detail of a comparison circuit in FIG. 3;

FIGS. 9C and 10C are timing charts of signals shown in FIGS. 9A, 9B and 10A, 10B;

FIG. 11 is a perspective view illustrating a great detail of the recording head and the ejection recovery unit in another embodiment of the present invention;

FIG. 12 is a block diagram illustrating an example of a major part of a control system in an ink jet recording apparatus using a recording head and so on show in FIG. 11; FIG. 13 is a flow chart illustrating an example of procedures in the control system shown in FIG. 12;

FIG. 14 is a block diagram illustrating an example of a major part of a control system in another embodiment of the present invention;

FIG. 15 is a perspective view of the recording head the ejection recovery unit in another embodiment of the invention.

Figure 1:
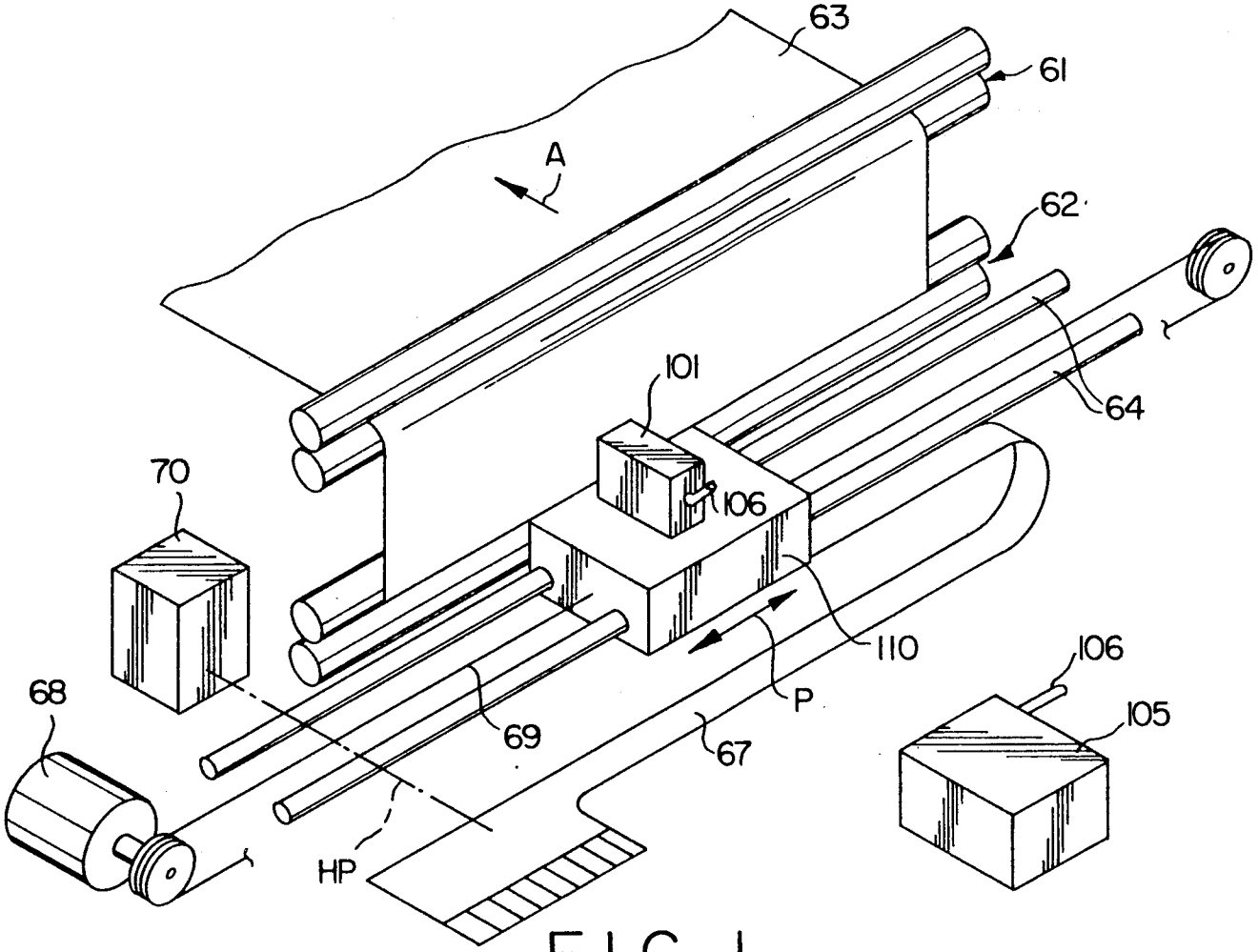
FIG. 1 PRIOR ART
FIG. 1 is a schematic perspective view showing an example of an ink jet recording apparatus to which the present invention is applicable.
Figure 16:
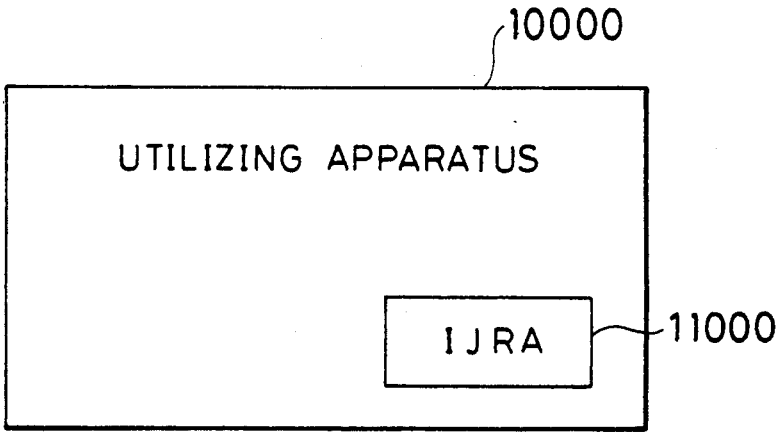
Figure 17:
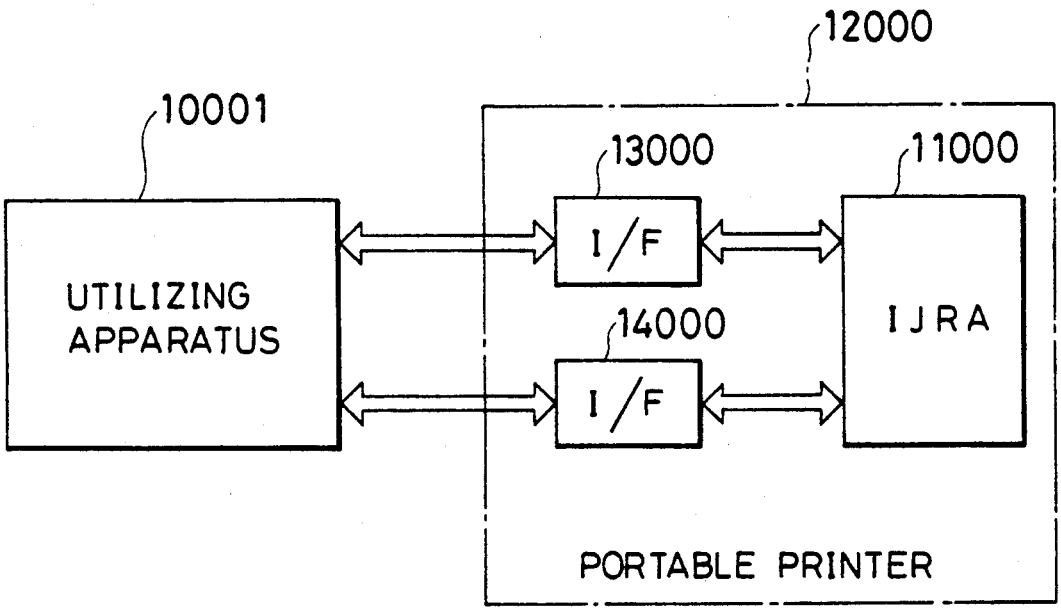

FIG. 16 is a schematic diagram illustrating an embodiment of an apparatus in accordance with the present invention to which the ink jet recording apparatus shown FIG. 1 is equipped; and FIG. 17 is a schematic drawing illustrating an embodiment of a portable printer in accordance with the present invention.

DETAILED DESCRIPTION OF PREFERRED EMBODIMENTS

FIG. 1 shows an embodiment of an ink jet recording apparatus to which the present invention is applicable.

In FIG. 1, a recording sheet 63, which is the recording medium made from paper or plastic thin film, is moved in the direction of an arrow A, being guided by sheet feet rollers 61 and 62, both pairs of rollers being placed at the upper and lower sides of the recording apparatus at a designated interval. Being parallel with and in front of the portion of the recording sheet 63 which is located between sheet feed rollers 61 and 62 in the vertical direction, a pair of guide shafts 64 is disposed and with the guide shafts 64, a carriage 110 is mounted so as to slide along the guide shafts 64 horizontally. And a recording head unit 101 is mounted on the carriage 110. With this structure, facing the ink ejection outlets of the recording head to the recording sheet 63, the recording head can move horizontally in the direction of an arrow P in the figure in front of the recording sheet 63.

At the front side of the recording head unit 101, the plurality of ink ejection outlets for ejecting ink droplets, which will be designated as ejection outlets in the description that follows, are disposed. As the recording head 101 is moving horizontally in front of the recording sheet 63, the clearance between these ejection outlets and the recording sheet 63 is kept to be a designated value, for instance, about 0.8 mm. A side-to-side motion of the carriage 110 is established by a transmission mechanism including a wire 69 and pulleys winding the wire 69 and by a carriage driving motor 68. Owing to this mechanism, the recording head unit 101 can be moved and positioned at designated positions.

The carriage 110 and a control unit of the recording apparatus of the embodiment of the present invention are connected electrically with a flexible cable for supplying the electric power source and communicating electric signals.

In the above structure, when the recording operation is performed, simultaneously with a movement of the carriage 100 in the direction of rows on the recording sheet, as shown by the arrow P in FIG. 1, the electro-thermal converting elements, each element provided with each corresponding ejection outlet in the recording head unit 101, are driven selectively in accordance with recording data so that ink droplets ejected from the ejection outlets corresponding to driven electro-thermal converting elements reach the surface of the recording sheet 63 and finally ink dots are established as forming recording information on the recording sheet 63.

The recording head unit 101 is positioned at a home position HP which is set outside the recording region by the recording head unit 101 when the recording head is not operated or at a scheduled time in a recording operation. In the neighboring area of the home position HP, placed is an ejection recovery unit 70 which has a cap for covering up the surface or which the ejection outlets of the recording head are disposed, and a pump for sucking ink from the ejection outlets through the cap and so on. The ejection recovery operations including the idle ejection and the ink suction which relate to the embodiment of the present invention and which are described later with reference to FIG. 5 are carried out by means of the ejection recovery unit 70 when the recording head unit 101 is positioned at the home position HP. An ink tank 105 used for containing ink supplied into the recording head unit 101 is arranged in an appropriate position in the recording apparatus. A tube 106 used for supplying the ink in the ink tank 105 for the recording head unit 101 has flexibility so as to follow the movement of the recording head unit 101.

Figure 2:
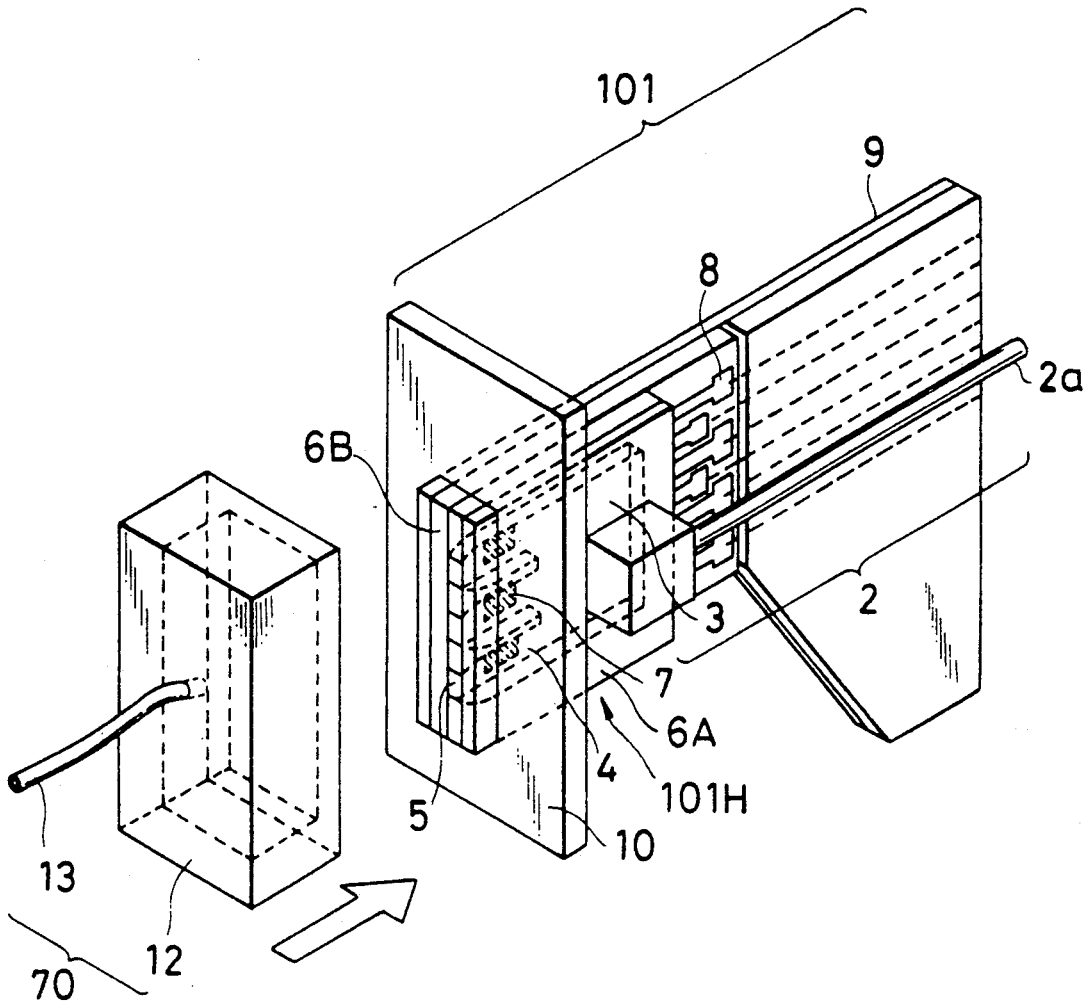
FIG. 2 is a perspective view illustrating a great detail of an example of a recording head and an ejection recovery unit in an embodiment of the present invention.

FIG. 2 shows a great detail of the ejection recovery unit 70 and the recording head unit 101 as shown in FIG. 1.

As for an ink supply path 2 for supplying ink into the recording head 101H, one end 2*a* of the ink supply path 2 is connected with the ink tank 105 through the tube 106 and the other end 2*b* of the ink supply path 2 is connected with a common chamber 3 in the recording head 101H. A plurality of ink liquid passages 4 connected with the common chamber 3 are disposed in the recording head 101H in FIG. 2 where only three of the ink liquid passages 4 are shown. An ejection outlet 5 port is formed as an open hole, from which ink droplets are ejected, at the opposite end side of each ink liquid passage to the common chamber 3. In a top plate 6, a concave portion is formed in order to establish the common chamber 3 and the ink liquid passages 4 and a substrate 6B is bonded onto the top plate 6A. In every region on the substrate 6B corresponding to each ink liquid passage 4, an electro-thermal converting element 7 is formed for generating thermal energy to be used to eject ink droplets.

Driving signals are supplied into the electro-thermal converting elements 7 through a wiring 8 which is connected with the control unit through the flexible cable 67 as shown in FIG. 1. The secondary board 9 forms a base member of the recording head unit 101 by supporting the substrate 6B and so on. A plate 10 is disposed in a vertical position to the direction in which ink droplets are ejected from the ejection outlets 5 at the end side of the recording head 101H. Sealing materials are filled in the bonded portions between the plate 100 and either the substrate 6B or the top plate 6A in order to prevent ink from penetrating into the bonded portions.

A reference numeral 12 in FIG. 2 designates a cap for forming the ejection recovery unit 70 as shown in FIG. 1 with which the face of the recording head 101H where the ejection outlets 5 are disposed can be covered. The cap 12 and a pump not shown in FIG. 2 are connected through a suction tube 13. So far, the cap 12 moves in the direction shown by an arrow in FIG. 2 by means of a moving means not shown in FIG. 2 which forms one part of the ejection recovery unit 70, and the cap 12 can cover up the face where the ejection outlets 5 are formed. By way of capping with the cap 12, evaporation of the solvent component of ink can be suppressed so that an increase of viscosity of ink can be prevented. In addition, by means of sucking ink by negative pressure in the cap 12 produced by the pump, the ejection outlets of the recording head 101H being covered with the cap 12, sticky ink and bubbles in ink which cause ink ejection failures can be removed, and further, fresh ink is refilled.

FIG. 3 shows a major part of a control system for the ink jet recording apparatus as shown in FIG. 1.

A control unit 50 supplies driving data and control signals to a heat generation part driving circuit 51 for driving electro-thermal converting elements, the heat generation part driving circuit 51 being formed in the recording head unit 101, so as to execute procedures described later with reference to FIG. 4. The control unit 50 may take a form of a micro computer including a CPU for executing the procedures mentioned above, a ROM for storing computer programs of the procedures and a RAM having a data expansion area and a work area used for the procedures and so on. And further, the control unit 50 controls mechanical actions of sheet feed rollers 61, 62 for feeding the recording sheet 63 and the carriage 110. The driving circuit 51 drives electro-thermal converting elements 7 according to the driving data supplied from the control unit 50. A resistance measurement circuit 53 measures the resistance value of the electro-thermal converting element 7, and a comparison circuit 56 compares the measured value obtained by the resistance measurement circuit 53 with a reference value designated by the control unit 50.

Figure 4A:
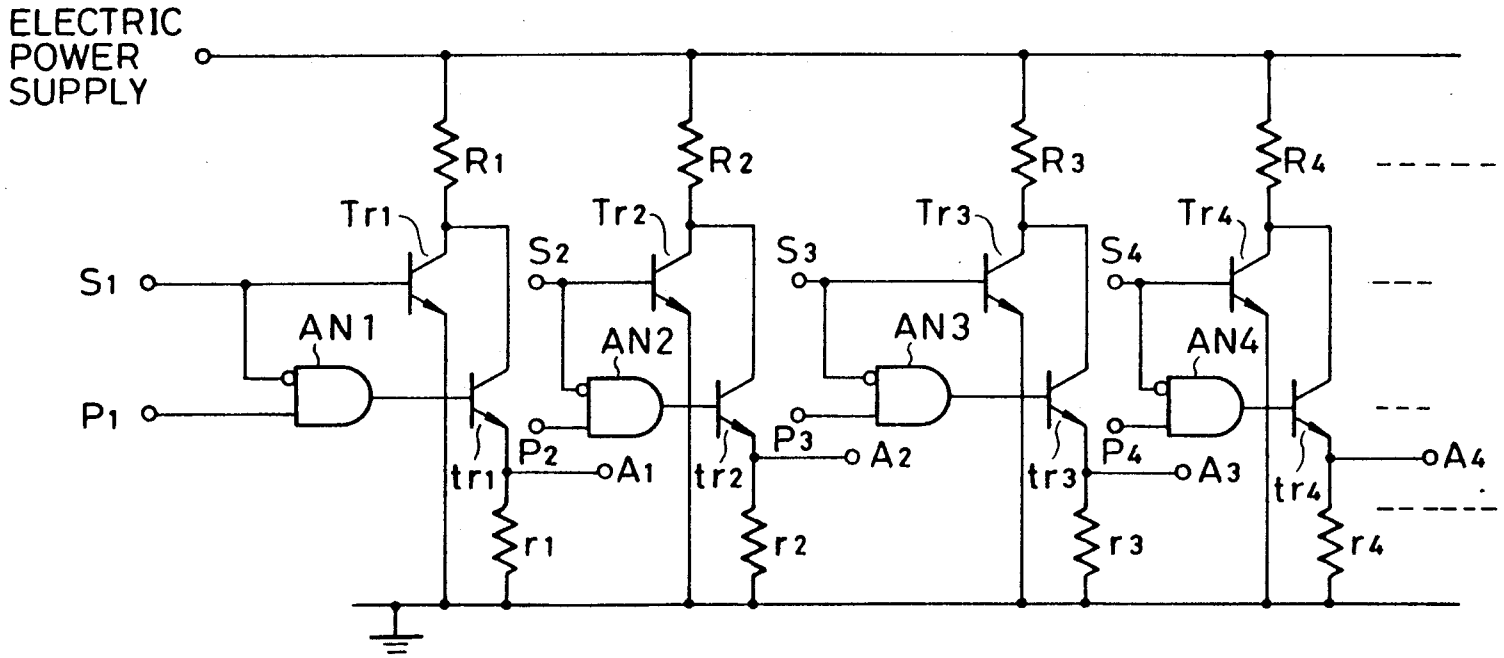
FIG. 4A is a circuit diagram illustrating an embodiment of a heat generation part driving circuit and a resistance measurement circuit, both circuits shown in FIG. 3.

FIG. 4A is a circuit diagram illustrating one embodiment of circuit structures of the heat generation part driving circuit 51 and the resistance measurement circuit 53.

In FIG. 4A, a plurality of electro-thermal converting elements 7 disposed in the recording head 101H are designated as $R_1$, $R_2$ and so on, and transistors $TR_1$, $TR_2$ and so on forming the heat generation part driving circuit 51 are provided, each corresponding to each of electro-thermal converting elements $R_1$, $R_2$ and so on. The transistors $TR_1$, $TR_2$ and so on switch on and off corresponding electro-thermal converting elements $R_1$, $R_2$ and so on according to driving signals $S_1$, $S_2$ and so on. Transistors $tr_1$, $tr_2$ and so on form the resistance measurement circuit 53. In measuring the resistance value of electro-thermal converting elements $R_1$, $R_2$ and so on transistors $tr_1$, $tr_2$ and so on are switched on and off by switching signals $P_1$, $P_2$ and so on from the control unit 50 so that each of measurement signals $A_1$, $A_2$ and so on can be obtained in response to each resistance value of electro-thermal converting elements $R_1$, $R_2$ and so on. Each of AND gates AN 1, AN 2 and so on receives each of the driving signals $S_1$, $S_2$ and so on at one input terminal, and receives each of the switching signals which are fed to the resistance measurement circuit 53 at the other input terminal. Owing to this configuration, it will be appreciated that an unfavorable situation in recording information can be avoided where transistors used for measuring resistance are operated by switching signals unnecessarily supplied for some reason while these switching signals are intended to drive transistors $Tr_1$, $Tr_2$ and so on for driving electro-thermal converting elements.

Figure 4B:
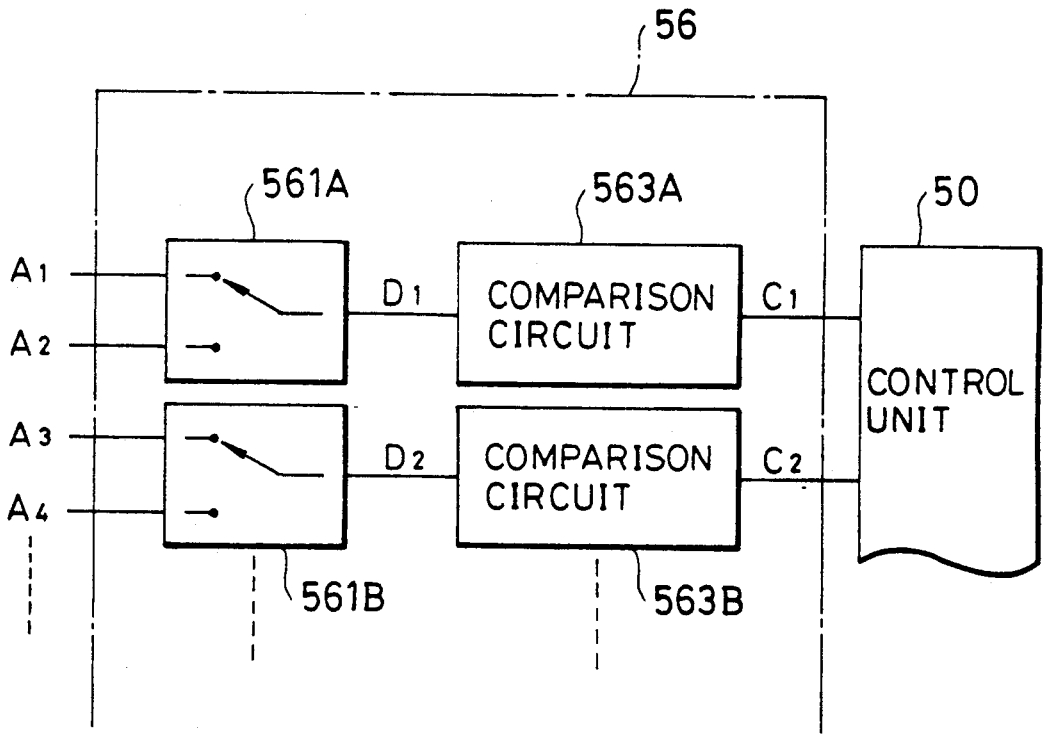
FIG. 4B is a block diagram of a detail of a comparison circuit in FIG. 3.
Figure 4C:
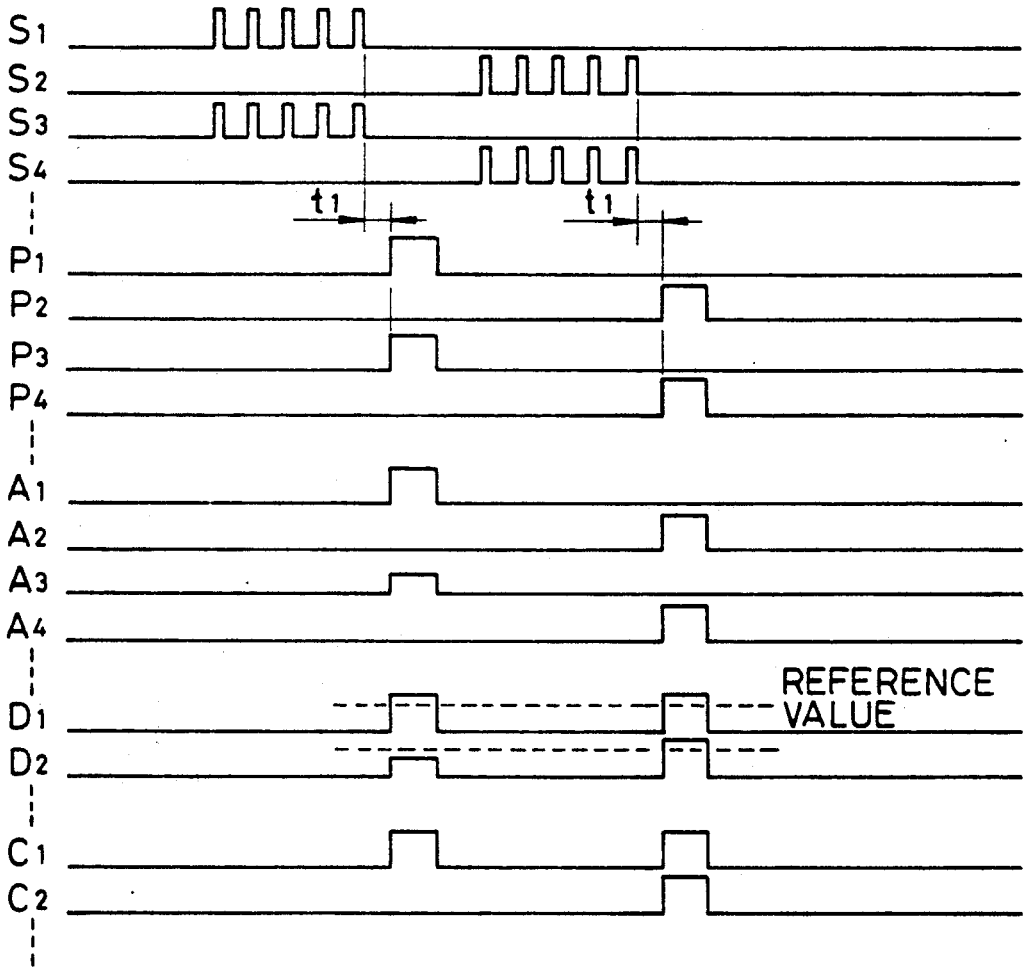

Now referring to FIGS. 4B and 4C, there is given an explanation of generation scheme of signals shown in FIG. 4A.

In this embodiment of the present invention, the electro-thermal converting elements are alternately driven by two blocks; a block of $R_1$, $R_3$ and so on and a block of $R_2$, $R_4$ and so on. As shown in a timing chart in FIG. 4C, at first, the driving signals $S_1$, $S_3$ and so on corresponding to the first block are generated as a sequence of five pulses and supplied to corresponding transistors $Tr_1$, $Tr_3$ and so on. Next, electric pulses in response to these sequential pulses are applied to the electro-thermal converting elements $R_1$, $R_3$ and so on so that in an ordinary case, ink droplets are ejected out of each ejection outlets. At the time a designated time $t_1$ has passed after these driving signals $S_1$, $S_3$ and so on were supplied, switching signals $P_1$, $P_3$ and so on corresponding to the block of the electro-thermal converting elements $R_1$, $R_3$ and so on are supplied to corresponding transistors $tr_1$, $tr_3$ and so on. In this way, designated electric signals are applied to the electro-thermal converting elements $R_1$, $R_3$ and so on in response to the switching signals $P_1$, $P_3$ and so on so that the measurement signals $A_1$, $A_3$ and so on are generated, each measurement signal has its own voltage value corresponding to the resistance value of each electro-thermal converting element $R_1$, $R_3$ and so on. FIG. 4C shows a case where the measurement signal $A_3$ detects an abnormal state of the ink liquid passage in which the electro-thermal converting element $R_3$ is formed. In other words, for instance, in case that the viscosity of ink increases, in case that bubbles are generated in ink or in case that a loss of ink occurs in the ink liquid passage, heat generated by the electro-thermal converting element $R_3$ is not diffused outside of the element $R_3$ but contributes directly to a temperature rise of the element $R_3$ itself and further. In the case where the electro-thermal converting element $R_3$ has a characteristic that its resistance increases with the increase in the temperature as shown in FIG. 7B, the temperature rise of the element $R_3$ itself makes the resistance value of the element $R_3$ greater. Owing to an increase of the resistance of the element $R_3$, the voltage value of the detected measurement signal $A_3$ gets smaller. The measurement signal $A_3$ to be supplied as a signal $D_2$ into the comparison circuit 563B gets smaller than the reference value, and hence, an output signal $C_2$ from the comparison circuit 563B turns into "0".

After the ink ejection and the resistance measurement procedures with respect to the first block of electro-thermal converting elements $R_1$, $R_3$ and so on were terminated, then the ink ejection and the resistance measurement procedures are carried out with respect to the second block of electro-thermal converting elements $R_2$, $R_4$ and so on in the same manner. So far, the first and second blocks of electro-thermal converting elements are driven alternatively. In this case, as shown in FIG. 4B, using data selectors 561A, 561B and so on, signals used in the comparison circuits are alternated to be $A_1$ with $A_2$, $A_3$ with $A_4$ and so on according to switching signals $P_1$, $P_2$ and so on. Owing to this circuit configuration, a structure of the comparison circuits 563 and the control unit 50 following to the data selectors 561 can be made simpler. The control unit 50 reads output signals from the comparison circuits 563A, 563B and so on in response to switching signals $P_1$, $P_2$ and so on, and uses its own procedures.

Incidentally, the circuit configuration and the timing chart as shown in FIGS. 4A and 4C, respectively, are provided to be supplied with the switching signals (measuring signals) Pk after continuous fine pulses of the driving signal Sk are supplied. Instead of the above arrangement, a circuit configuration and a timing chart may be provided to be supplied with the measuring signals Pk while the driving signals Sk are being supplied. In this case, as the detecting of the abnormal state can be carried out faster, the number of the driving signals for detecting the abnormal state can be reduced so that a possibility of damaging the electro-thermal converting element can be further reduced.

Furthermore, the number of the driving signals, which is fine in the embodiment described with reference to FIGS. 4A to 4C, is set within a certain extent which is determined by considering thermal influence on other ink liquid passages, and a magnitude of the electric energy of the driving signal or the like. In other words, the measurement of the resistance value can be carried out without influences exerted by other ink liquid passages by the number of the driving signals within the certain extent being supplied to the electro-thermal converting element.

As described above, it will be appreciated that a state of each ink liquid passage can be detected by means of measurement signals of resistance of its corresponding electro-thermal converting element to each ink liquid passage. That is, in case that there exists any abnormal state in the ink liquid passage such as the increase of viscosity of ink, the existence of bubbles generated in ink or a loss of ink, the output signal from the comparison circuit turns into "0".

Driving signals $S_1$, $S_2$ and so on are, as described above, also used to be driving signals for ejecting ink droplets in the recording operation and in case that there exists no abnormal state in the ink liquid passages, ink droplets are ejected from the ejection outlets in response to supplied driving signals $S_1$, $S_2$ and so on. Therefore, the procedure for detecting the abnormal state of the ink liquid passages can be done in a part of a procedure for the ejection recovery operations capability as described later in FIG. 5. In this case, the ink ejection by means of driving signals $S_1$, $S_2$ and so on is a so-called idle ejection and by the idle ejection, ink which has high viscosity and/or contains bubbles can be removed from the ink liquid passages. In addition, if the meniscus of ink is displaced downward from the ejection outlet to a little extent, the meniscus can be moved into a proper position by the idle ejection of ink. So far, in this embodiment of the present invention, only the serious abnormal state in the ink liquid passages which cannot be recovered by the above mentioned idle ejection is detected and the suction procedure can be performed in accordance with the abnormal state detection, it will be appreciated that unnecessary suction procedure can be eliminated.

In the above described embodiment of the present invention, though disclosed is such an example of driving electro-thermal converting elements R1, R2 and so on as to be done alternatively by two blocks of elements, driving methods of electro-thermal converting elements are not limited into the example as shown above but alternatives can be practiced within the spirit of the present invention.

For instance, there is no limit to the number of blocks and that of the electro-thermal converting elements which are contained in one block. Furthermore, a plurality of electro-thermal converting elements are driven not for each block, but may be driven for each individual element.

However, from a point of view with respect to time spent in procedures and capacity of an electric power supply source, the method for driving the electro-thermal converting element which is used for the recording operation is more preferable where the elements are driven alternately by blocks to be applied equally to driving the electro-thermal converting elements for the idle ejection of ink and to measuring resistance of the elements. In a specific example of this method for driving electro-thermal converting elements, as well known in prior art systems, for instance, there exist 128 ejection outlets and their corresponding 128 electro-thermal converting elements, and 16 blocks, each containing 8 electro-thermal converting elements, are selected alternately to be driven at one time. According to this circuit configuration, in driving the elements both for recording operation and for procedures related directly to the embodiment of the present invention, driving procedures of each block of electro-thermal converting elements can share circuits for driving the elements such as the driving signal generation circuit, the comparison circuit and the control unit and so on. Furthermore, in case that the recording head has relatively many electro-thermal converting elements, the time for detecting the abnormality can be reduced by that the electro-thermal converting elements are driven and the resistance of the elements are measured alternately by blocks.

FIG. 5 shows procedures to which the present invention is applied and which can be invoked at any time such as before the recording operation begins, after recording a designated amount of information, after recording for a designated time, when recording operation is interrupted and so on.

At the first step of the procedures in FIG. 5, in step S1, the recording head unit 101 moves to the home position HP, and the ejection outlets 5 and their neighboring area are covered with the cap 12 and insulated from atmospheric air.

Next, in step S3, selected are a plurality of ejection outlets of the designated block in accordance with driving signals Sk as described in FIGS. 4A, 4B and 4C. In step S5, to corresponding heat generation part driving circuit 51, the designated number of sequential pulse signals Sk is supplied so that the idle ejection of ink are carried out as a part of the ejection recovery operation. As a result, thermal energy is applied to ink at the electro-thermal converting elements Rk..

In step S5, if there exist no abnormal state in the corresponding ink liquid passages, in ink to which the thermal energy was given, a state change and a rapid voluminous change occur, and thereby, ink droplet is ejected respectively by means of this rapid voluminous change of ink.

However, in case that the loss of ink in the ink liquid passages takes place or there exist the increase of viscosity of ink or the generation of small-sized bubbles in ink, then thermal energy given to the electro-thermal converting element Rk is not used to eject ink droplet but stored as heat at the electro-thermal converting element itself and its neighboring heat generation part. As a result, as shown in FIG. 6, temperature of the heat generation part increases more rapidly and saturation temperature is higher than the case, for example, where ink is filled at the heat generation part. In this case, as shown in FIG. 7A or FIG. 7B, in proportion to a temperature increase of the heat generation part, the electric resistance value of the electro-thermal converting element decreases or increases. Depend on the property of materials used for forming an electro-thermal converting element, electro-thermal converting elements are categorized into two types with respect to their characteristics to temperature change. In this embodiment, an electro-thermal converting element with its material having the characteristic as shown in FIG. 7B is used. The invention may employ other kinds of materials used for electro-thermal converting elements with its characteristics shown in FIG. 7A without departing from the invention's spirit or essential concept.

Next, in step S7, as described in FIGS. 4A through 4C, by means of switching signals Pk, the operation mode of the circuit is turned from driving mode to resistance measurement mode and then, the resistance of an electro-thermal converting elements Rk are measured with measuring signals Ak to estimate a change in resistance value of an electro-thermal converting element Rk according to measured signal Ak.

And further, in step S9, the measured signal Ak is compared representative of a designated reference value with no abnormal state being found in the ink liquid passage, and it is determined whether the abnormal state occurs in the ink liquid passage or not according to the comparison result output Ck. If there exists some abnormal state in step S15, the ejection recovery operations are executed by sucking ink for eliminating such an abnormal state. In a detailed description, by means of operating the suction pump mounted in the ink jet recording apparatus and lowering the pressure in the cap 12 ink is discharged from the ejection outlets so that fresh ink can be supplied into all the ink liquid passages in the recording head easily. In addition, in case that elimination of an abnormal state cannot be attained even after three times of the ejection recovery operations, this situation is reported by alarm signals (step S13).

Because a set of steps, S3, S5, S7, S9, S13 and S15, is served in a repetitive manner to test every ejection outlet, where its repetition is controlled by step S11, and the abnormal state of each ink liquid passage can be detected independently, ink is refilled by the suction operation only when the ejection outlet with their corresponding ink liquid passage is detected to be abnormal. In this way, the ink jet recording apparatus can be formed not to waste unnecessary ink for the ejection recovery operations but to attain an efficient and stable operation of the apparatus.

Having described above the preferred embodiment of the present invention, the following will appreciated.

(1) By means of sucking ink only when necessary and reducing the amount of ink wasted unnecessarily, the consumption of ink can be reduced, (2) By means of repeating automatically the ejection recovery operations until the abnormal states of all the ink liquid passages, if any, are restored and making an operator free from repetitive tasks of observing recorded ink dots and operating ejection recovery operations with the above mentioned apparatus, time spent for recovery operations can be reduced.

(3) By means of measuring resistance of the electro-thermal converting elements, a breaking down of wire and a short circuit in a heat generation part can be detected.

FIG. 8A shows procedures relating to another embodiment of the present invention.

In this example, emphasized is a feature of an electro-thermal converting element in which the resistance of the element is deviated after electric energy for ejecting ink droplets is applied, and more specifically, its deviation value depends on a presence of the abnormal state in the ink liquid passage. Based upon this feature, in step S2 in FIG. 8A which is inserted between steps S1 and S3 in FIG. 5, it is judged whether measurement of an initial resistance of the electro-thermal converting element, i.e., the resistance before application of electric energy for ink droplets ejection, has been done or not. In case that the measurement of the resistance of all the electro-thermal converting elements has not been yet completed, all the resistance of all the electro-thermal converting elements are measured before applying electric energy for ink droplets ejection in steps S21, S23 and S25. And after the measurement of the initial resistance of all the electro-thermal converting elements is completed, the resistance after applying of electric energy for ink droplets ejection is measured in steps S3, S5 and S7. And further, in step S9, a presence of the abnormal state of respective electro-thermal converting elements is detected according to the deviated value in the resistance of the element.

The embodiment shown in FIG. 8A also brings the same effect as the embodiment shown in FIG. 5 does. In addition, in the embodiment shown in FIG. 8A, as a presence of the abnormal state of electro-thermal converting elements can be detected according to the resistance change corrected with the temperature change in the surrounding parts around the elements, there is an advantage in that the detection of abnormal states is little influenced by the temperature change in the surrounding parts around the elements.

FIG. 8B shows procedures in further embodiment of the present invention.

Procedures shown in FIG. 5 can be invoked at any time in the recording operation with the recording head, for example, when the recording operation of a set of information is interrupted, i.e., at starting a new line in a serial-type printer. This embodiment relates to the case where these p ocedures for the ejection recovery operations at the ejection outlets at the time of starting a new line.

In this embodiment, after ejecting ink droplets by driving electro-thermal converting elements for recording a single unit of information on a designated line in step S31, the next control signal is examined to be whether for staring a new line or not in step S33. If the next control signal is for starting a new line, procedures for detecting the abnormal state in the ink liquid passages are executed in steps S3, S5, S7, S9, S11, S13 and S15 before starting recording information in the next line. Then, the procedures described above have been done until the recording ends (step S35).

Incidentally, the idle ejection in step S5 which is also a part of the abnormality detection procedures to be carried out before the recording of the new line starts, is carried out not at the inside of the cap as described with respect to the embodiments, but at the ink absorber or the like (not shown in FIG. 1) which is disposed between the cap and the region for recording by the recording head. Instead of this arrangement, one more ink absorber may be disposed at another side of the region for recording. This arrangement is especially effective for an ink jet recording apparatus wherein the ink ejection for recording information is carried out in accordance with reciprocating movements of the recording head.

Furthermore, the idle ejection in step S5 may be carried out at the cap not capping the recording head. Furthermore, in step S12, the preparation procedure for the recording operation is performed before the recording operation in step S31.

In this embodiment, it will be appreciated that an unfavorable situation can be avoided where driving signals for recording information are applied to electro-thermal converting elements in recording the set of information while the appropriate ejection recovery operations can not be taken and ink droplets can not be ejected from the ejection outlets where the abnormal state occurs.

Furthermore, in this embodiment, the abnormality detection procedure is carried out when the recording operation is interrupted so that a reliable recording operation can be carried out without increasing the time for the recording operation and without the ejection failure. Further, the abnormality detection procedure of this embodiment can be carried out by using a common method for driving the electro-thermal converting elements.

The present invention is not limited to the above embodiments, and its modifications and alternatives can be practiced. For example, with respect to an apparatus for ejection recovery operations by refilling fresh ink into the ink liquid passages, there may be an apparatus where sticky or bubble-containing ink is sucked from a designated number of ejection outlets instead of being sucked from all the ejection outlets. In this apparatus, the consumption of ink can be further reduced. And instead of using suction operation by the cap covering the ejection outlets, the present invention may be embodied by using pressurizing operation of ink in the ink supply passage. And furthermore, only by using the idle ejection of ink from ejection outlets if the number of the pulses signals for ink droplets ejection could be taken to be an appropriate number, the ejection recovery operation can be accomplished thereby, and as a result, it will be appreciated that only the ink liquid passages having the abnormal state can be restored.

FIGS. 9A, 9B and 9C show another embodiment of circuit described earlier in FIGS. 4A through 4C. In this embodiment, the switching signal Pk and the AND gate ANk in the embodiment shown by FIGS. 4A through 4C are used commonly in each block of electro-thermal converting elements. That is, in driving electro-thermal converting elements for measuring the resistance of the elements, a single switching signal can be used for switching each single block. Owing to this circuit configuration, for example, in case of driving electro-thermal converting elements by two blocks, only two switching signals can be used. FIGS. 9A though 9C show the same case as that shown in FIGS. 4A through 4C where electro-thermal converting elements are driven as shown in the time chart and there exists the abnormal state in the ink liquid passage corresponding to the electro-thermal converting element $R_3$.

FIGS. 10A through 10C show further embodiment of circuit described earlier in FIGS. 4A through 4C. In this embodiment, the resistor r for detecting measurement signals and the output terminal of measurement signals in the embodiment shown by FIGS. 4A through 4C are used commonly in each block of electro-thermal converting elements. Assuming here that electro-thermal converting elements are grouped into two blocks, as the electro-thermal converting elements $R_1$ and $R_2$, or $R_3$ and $R_4$ and so on are not grouped in an identical block with respect to their driving, they are not driven concurrently for measuring their resistance. Using these characteristics of driving operation of the blocked electro-thermal converting elements, the single resistor r for detecting measurement signals and the single output terminal of measurement signals can be used for measuring the resistance of each single block of electro-thermal converting elements, and hence, the circuit structure can be simplified. And furthermore, the data selector can be eliminated.

The embodiments described by referring to FIGS. 1 through 10 relates to the apparatus where the abnormal state is detected by using the resistance change of electro-thermal converting elements in accordance with the temperature change in the elements. In contrast with the above described embodiments, the embodiment which will be described as follows relates to an apparatus where a presence of the abnormal state in the ink liquid passages is judged by supplying driving signals to the electro-thermal converting element and using a sound-wave generated by the electro-thermal converting element in response to the supplied driving signals. This embodiment will be disclosed as follows.

FIG. 11 illustrates a detailed configuration of the ejection recovery unit and the recording head unit in the embodiment of the present invention. An ink jet recording apparatus in this embodiment of the present invention may have the same structure as the apparatus shown in FIGS. 1 through 10, and therefore, like parts are designated with like numerals throughout the accompanying figures without detailed description about them.

FIG. 11 differs from FIG. 2 with respect to the following configuration of the apparatus. That is, a sound-wave detecting unit 11 is fixed with an adhesive agent or screws onto the portion of the secondary board 9, the portion relatively close to an electro-thermal converting elements 7, and signal lines 11*a* from the unit for detecting a sound-wave is connected to a low frequency amplifier disposed in the ink jet recording apparatus. As for a frequency characteristic generic to the sound-wave detecting unit 11, it is desirable to form the sound-wave detecting unit so that the sound-wave detecting unit may detect the sound-wave with its frequency much higher than that of the driving signals supplied to the electro-thermal converting elements 7.

FIG. 12 shows a main part of a control system in the ink jet recording apparatus in the embodiment of the present invention.

In FIG. 12, a low frequency amplifier 1052 amplifies the output signal from a sound-wave detecting unit 11. A filter 1053 extracts a component with a designated frequency from an output signal of the low frequency amplifier 1052, and the extracted signal component is supplied into a comparator 56 through an A/D converter 1054 and a delay circuit 1055. The comparator 56 compares the phase of an output signal from a control unit 50 with the phase of an output signal from the delay circuit 1055.

FIG. 13 shows, in a similar way to FIG. 5, procedures to which the present invention is applied and which can be invoked at any time such as before recording procedures begin, after recording a designated amount of information, after recording for a designated time, when recording procedures are interrupted and so on.

At the first step of the procedures in FIG. 13, in step S1, the recording head unit 101 moves to the home position HP, and the ejection outlets 5 and their neighboring area are covered with the cap 12 and insulated from atmospheric air.

Next, in step S3, the control unit 50 selects one electro-thermal converting element corresponding to a designated ejection outlet, and, in step S5 supplies a series of driving signals having a designated frequency to a driving circuit 51 corresponding to the selected electro-thermal converting element. Thereby, the electro-thermal converting element gives kinetic energy to ink in the ink liquid passage connected to the corresponding ejection outlet.

In step S5, if there exists no abnormal state in the ink liquid passage, thermal energy applied to the ink gives rise to a state change and a rapid voluminous expansion. And next, when supplying of thermal energy is stopped, a voluminous compression occurs in ink, for example, in 30 to 40 μsec delay.

Due to alternating two kinds of voluminous changes in ink, i.e., expansion and compression, the sound-wave is generated outside from the ink liquid passage 4 with its frequency determined in response to the frequency of the driving signal supplied by the controller 50.

This sound-wave is promptly detected by a sound-wave detecting apparatus 11, and the detected signal is amplified by the low frequency amplifier 1052 and in the filter 1053, a designated frequency component of the amplified signal is extracted for being used for abnormality judgement. And next, the extracted frequency component of the detected signal is transformed into a digital signal by the A/D converter 1054 and the phase of the digital signal is modified by a delay circuit 1055. And finally, in a comparator 1056, the digital signal is compared with a reference signal generated by the control unit 50.

In step S7, the control unit 50 examines the comparison result of the reference signal and the detected signal with respect to their frequency and phase by means of detecting acoustic emission. In case that the frequency and the phase of both signals are identical to each other, respectively it is judged that the acoustic emission is obtained as a result of the rapid voluminous change of ink in the designated ink liquid passage, and that there exists well-conditioned ink in the ink liquid passage. While this case holds true, steps S3, S5 and S7 are processed in a repetitive manner (step S9).

In a process of repetition of steps S3, S5 and S7, if the abnormal state is detected by means of detecting acoustic emission from ink, the repetition is terminated at step S7 and step S11 is further reached in order to start the ejection recovery unit 70 for sucking damaged ink and to refill fresh ink into the ink liquid passage where the abnormal state is found. After refilling fresh ink into the designated ink liquid passage, above procedures for detecting the abnormal state in the ink liquid passage may be invoked again.

As described above, also in this embodiment of the present invention where using acoustic emission for abnormality detection, it will be appreciated that whether ink is filled or not can be examined with respect to respective ink liquid passage and that calling of procedures for refilling fresh ink can be triggered in response to the above examination result.

As an alternative form of the procedural flow in FIG. 13, step S11 may be executed after detecting the abnormal state in steps S3, S5, S7 and S9, with respect to all the ejection outlets. And further after step S11, the ejection outlet having the abnormal state, if any, may be tested with procedures in steps S3, S5 and S7.

FIG. 14 shows another embodiment of a control system in the present invention.

In this embodiment in the same way as described in the above embodiment, a sound-wave detected by the sound-wave detecting unit 11 is amplified by the low frequency amplifier 1052, and next, a necessary frequency component of the detected signal is extracted by the filter 1053. And further, the filtered signal is transformed into "0" or "1" binary signal in a two-value synthesis unit 1058, and the control unit 50 receives this binary signal and judges a presence of the abnormal state of the ink liquid passage, according to the accentuation of the signal. The rest of parts of the control system described by FIG. 14 may be formed by the same parts as shown in FIG. 12.

As for the intensity of the sound-wave generated outside from the ink liquid passage, it is desirable to form the sound-wave generated so that the intensity of the sound-wave generated outside from the ink liquid passage for detecting the abnormal state may be much greater than that of the sound-wave generated by other portions of the ink jet recording apparatus with its frequency equal to that of the sound-wave used for abnormality detection.

Though this embodiment brings the same advantages as the embodiment described earlier, the structure of the apparatus for detecting the existence of ink in the respective ink liquid passage can be more simplified by way of relatively simplified means.

Finally, FIG. 15 further shows another embodiment of the present invention.

In this embodiment, FIG. 15 differs from an example shown by FIG. 11 with respect to the way of mounting the sound-wave detecting unit 11 in an appropriate position on a base board 15 of the recording apparatus with a bracket 14. The rest of parts and their configuration shown in FIG. 11 can be used in the example of FIG. 15 commonly.

As for an advantages in this embodiment, it will be appreciated that the recording head and the sound-wave detecting unit can be formed and fabricated separately in such a form that the recording head may be easily exchangeable.

Having above described embodiments of the present invention, it will occur to those skilled in the art that modifications and alternatives can be practiced within the spirit of the invention. It is accordingly intended to define the scope of the invention only as indicated in the following claims.

The present invention is particularly suitably useable in an ink jet recording head having heating elements that produce thermal energy as energy used for ink ejection and recording apparatus using the head. This is because, due to the high density of the picture elements, high resolution of recording is possible.

The typical structure and the operational principle are preferably those disclosed in U.S. Pat. Nos. 4,723,129 and 4,740,796. The principle is applicable to a so-called on-demand type recording system and a continuous type recording system. Particularly however, it is suitable for the on-demand type because the principle is such that at least one driving signal is applied to an electro-thermal transducer disposed on liquid (ink) retaining sheet or liquid passage, the driving signal being enough to provide such a quick temperature rise beyond a departure from nucleate boiling point, by which the thermal energy is provided by the electro-thermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electro-thermal transducer as disclosed in the above-mentioned patents. In addition, the present invention is applicable to the structure disclosed in Japanese Patent Application Laying-Open No. 123670/1984 wherein a common slit is used as the ejection outlet for a plurality of electro-thermal transducers, and to the structure disclosed in Japanese Patent Application Laying-Open No. 138461/1984 wherein an opening for absorbing pressure waves of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality of recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electro-thermal transducer or by a combination of the ejection electro-thermal transducer and additional heating element and means for preliminary ejection not for the recording operation, which can stabilize the recording operation.

As regards the kinds and the number of the recording heads mounted, a single head corresponding to a single color ink may be equipped, or a plurality of heads corresponding respectively to a plurality of ink materials having different recording colors or densities may be equipped. The present invention is effectively applicable to an apparatus having at least one of a monochromatic mode solely with main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquified at the room temperature. Since in the ink jet recording system, the ink is controlled within the temperature not less than 30° C. and not more than 70° C. to stabilize the viscosity of the ink to provide the stabilized ejection, in usual recording apparatuses of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is unused is effective to prevent the evaporation of the ink. In either of the cases, upon the application of the recording signal producing thermal energy, the ink may be liquified, and the liquified ink may be ejected. The ink may start to be solidified at the time when it reaches the recording material. The present invention is applicable to such an ink material as is liquified by the application of the thermal energy. Such an ink material may be retained as a liquid or solid material on through holes or recesses formed in a porous sheet as disclosed in Japanese Patent Application Laying-Open No. 56847/1979 and Japanese Patent Application Laying-Open No. 71260/1985. The sheet is faced to the electro-thermal transducers. The most effective one for the ink materials described above is the film boiling system.

The ink jet recording apparatus may be used as an output means of various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatuses require means for outputting processed information in the form of hard copy.

FIG. 16 schematically illustrates one embodiment of a utilizing apparatus in accordance with the present invention to which the ink jet recording system shown in FIG. 1 is equipped as an output means for outputting processed information.

In FIG. 16, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 1. The ink jet recording apparatus (IJRA) 11000 receives processed information from the utilizing apparatus 10000 and provides a print output as hard copy under the control of the utilizing apparatus 10000.

FIG. 17 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 17, reference numeral 10001 schematically denotes such a utilizing apparatus. Reference numeral 12000 schematically denotes a portable printer having the ink jet recording apparatus (IJRA) 11000 shown FIG. 1 in incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. An ink jet recording apparatus for recording information by ejecting ink droplets onto a recording medium, said apparatus comprising:

a recording head having a plurality of ejection outlets for ejecting ink droplets, a plurality of ink liquid passages, each ink liquid passages having a normal or abnormal state and corresponding to a respective one of said plurality of ejection outlets, and a plurality of electro-thermal converting elements for generating thermal energy for ejecting the ink droplets, each of said plurality of electro-thermal converting elements being located in a respective one of said plurality of ink liquid passages, and said plurality of electro-thermal converting elements being used in such a manner as to be divided into a predetermined number of blocks when said plurality of electro-converting elements are driven and a state of said plurality of electro-converting elements are detected;

driving means for driving said plurality of electro-thermal converting elements by individual blocks of the predetermined number of blocks to generate the thermal energy;

detecting means for, on the basis of each individual block of the predetermined number of blocks, detecting respective signals in accordance with designated state changes occurring in said plurality of electro-thermal converting elements of one block or designated state changes in said plurality of ink liquid passages corresponding to said plurality of electro-thermal converting elements in the one block when said driving means drives said plurality of electro-thermal converting elements of the one block; and judging means for judging a presence of an abnormal state in each of said plurality of ink liquid passages of the one block according to the signal detected by said detecting means.

2. An ink jet recording apparatus as claimed in claim 1, wherein the driving of said plurality of electro-thermal converting elements by said driving means is performed as a part of ejection recovery procedures by which some of the ink droplets are ejected from said recording head so that the ink in said plurality of ink liquid passages of the one block is discharged therefrom.

3. An ink jet recording apparatus for recording information by ejecting ink droplets onto a recording medium, said apparatus comprising:

a recording head having a plurality of ejection outlets for ejecting ink droplets, a plurality of ink liquid passages, each ink liquid passage corresponding to a respective one of said plurality of ejection outlets, each ink liquid having a normal or an abnormal state, and a plurality of electro-thermal converting elements for generating thermal energy for ejecting the ink droplets, each of said plurality of electro-thermal converting elements having a resistance valve and being located in a respective one of said plurality of ink liquid passages, and said plurality of electro-thermal converting elements being used in such a manner as to be divided into a predetermined number of blocks when a state of said plurality of electro-converting elements are measured;

driving means for driving said electro-thermal converting elements of said recording head to generate thermal energy enough to eject the ink droplets;

measuring means for, on a basis of individual blocks of the predetermined number of blocks, measuring respective signals in accordance with resistance values of said plurality of electro-thermal converting elements of one block; and judging means for judging presence of an abnormal state in each of said plurality of ink liquid passages of the one block according to the signals measured by said measuring means.

4. An ink jet recording apparatus as claimed in claim 3, wherein the driving of said plurality of electro-thermal converting elements by said driving means is performed as a part of ejection recovery procedures by which some of the ink droplets are ejected so that the ink in said plurality of ink liquid passages of the one block is discharged therefrom.

5. An ink jet recording apparatus for recording information by ejecting ink droplets onto a recording medium, said apparatus comprising:

a recording head having a plurality of ejection outlets for ejecting ink droplets, a plurality of ink liquid passages, each ink liquid passage having a normal or abnormal state and corresponding to a respective one of said plurality of ejection outlets, and a plurality of electro-thermal converting elements for generating thermal energy for ejecting the ink droplets, each os said plurality of electro-thermal converting elements having a resistance value and being located in a respective one of said plurality of ink liquid passages, and said plurality of electro-thermal converting elements being used in such a manner as to be divided into a predetermined number of blocks when a state of said plurality of electro-converting elements are measured;

driving means for driving said electro-thermal converting elements of said recording head to generate the thermal energy enough to eject the ink droplets;

measuring means for, on a basis of individual blocks of the predetermined number of blocks, measuring respective signals in accordance with resistance values of said plurality of electro-thermal converting elements of one block;

judging means for judging a presence of an abnormal state in each of said plurality of ink liquid passages of the one block according to the signals measured by said measuring means; and ejection recovery means for discharging ink from said plurality of ink liquid passages when said judging means judges a presence of the abnormal state.

6. An ink jet recording apparatus as claimed in claim 5, wherein the discharging of ink by said ejection recovery means is performed by suction of the ink or pressurizing the ink.

7. An ink jet recording apparatus for recording information by ejecting ink droplets onto a recording medium, said apparatus comprising:

a recording head having a plurality of ejection outlets for ejecting ink droplets, a plurality of ink liquid passages, each ink liquid passage having a normal or abnormal state and corresponding to a respective one of said plurality of ejection outlets, and a plurality of electro-thermal converting elements, each of which is located in a respective one of said plurality of ink liquid passages, for generating thermal energy for ejecting the ink droplets;

driving means for driving said plurality of electro-thermal converting elements of said recording head to generate the thermal energy;

sound-wave detecting means for detecting a sound wave occurring in each of said ink liquid passages while the ink droplets are caused to be ejected by said driving means, said sound-wave detecting means being disposed in a neighborhood of said recording head; and judging means for judging a presence of an abnormal state in each of said plurality of ink liquid passages according to the sound-wave detected by said sound-wave detecting means .

* * * * *

UNITED STATES PATENT AND TRADEMARK OFFICE

CERTIFICATE OF CORRECTION

PATENT NO. : 5,182,580 Page 1 of 6

DATED : January 26, 1993

INVENTOR(S) : Kazue IKEDA, et al.

It is certified that error appears in the above-indentified patent and that said Letters Patent is hereby corrected as shown below:

Title page, item [75] Inventors:

Change "Ujita, Yamato, both of Japan" should read --Ujita, Yamato; Kenjiro Watanabe, Tokyo, all of Japan--.

item [56] - Attorney, Agent or Firm:

After "*Primary Examiner*--Joseph W. Hartary" insert --*Attorney, Agent or Firm*-Fitzpatrick, Cella, Harper & Scinto--.

item [57] - ABSTRACT:

Line 7, "tron-thermal" should read --tro-thermal--.

COLUMN 1:

Line 24, "Laying-Open" should read --Laid-Open--.

COLUMN 3:

Line 19, "Laying-Open" should read --Laid-Open--;

Line 36, "Laying-Open" should read --Laid-Open--;

UNITED STATES PATENT AND TRADEMARK OFFICE

CERTIFICATE OF CORRECTION

PATENT NO. : 5,182,580 Page 2 of 6

DATED : January 26, 1993

INVENTOR(S) : Kazue IKEDA, et al.

It is certified that error appears in the above-indentified patent and that said Letters Patent is hereby corrected as shown below:

Line 40, "droplet," should read --droplets,--.

COLUMN 4:

Line 3, "as low as" should read --sufficiently low so--;

Line 13, "and" should read --an--;

Line 56, "drive" should read --drives--.

COLUMN 5:

Line 9, "drive" should read --drives--;

Line 32, "a" should be deleted; and "sound" should read --a sound--;

Line 38, "drives means driving" should read --driving means drives--.

COLUMN 6:

Line 8, "a electron-" should read --an electro- --;

Line 11, "other two" should read --two other--;

Line 26, "FIG. 13" should begin a new paragraph.

UNITED STATES PATENT AND TRADEMARK OFFICE

CERTIFICATE OF CORRECTION

PATENT NO. : 5,182,580 Page 3 of 6

DATED : January 26, 1993

INVENTOR(S) : Kazue IKEDA, et al.

It is certified that error appears in the above-indentified patent and that said Letters Patent is hereby corrected as shown below:

COLUMN 7:

Line 32, "or" should read --on--.

COLUMN 11:

Line 10, "alternatively" should read --alternately--;

Line 65, "are" should read --is--.

COLUMN 12:

Line 1, "exist" should read --exists--;

Line 4, "ink" should read --an ink--;

Line 11, "ink" should read --the ink--;

Line 21, "Depend" should read --Depending--;

Line 36, "elements Rk are" should read --element Rk is--;

Line 37, "signals Ak" should read --signal Ak--.

UNITED STATES PATENT AND TRADEMARK OFFICE

CERTIFICATE OF CORRECTION

PATENT NO. : 5,182,580 Page 4 of 6

DATED : January 26, 1993

INVENTOR(S) : Kazue IKEDA, et al.

It is certified that error appears in the above-indentified patent and that said Letters Patent is hereby corrected as shown below:

COLUMN 13:

Line 5, "reduced," should read --reduced.--;

Line 53, "in" should read --in a--;

Line 67, "staring" should read --starting--.

COLUMN 15:

Line 10, "show" should read --show a--; "of" should read --of a--;

Line 31, "relates" should read --relate--;

Line 57, "elements" should read --element--;

Line 65, "elements" should read --element--.

COLUMN 17:

Line 60, "advantages" should read --advantage--.

COLUMN 18:

Line 42, "Laying-Open" should read --Laid-Open--;

Line 46, "Laying-Open" should read --Laid-Open--.

UNITED STATES PATENT AND TRADEMARK OFFICE

CERTIFICATE OF CORRECTION

PATENT NO. : 5,182,580 Page 5 of 6

DATED : January 26, 1993

INVENTOR(S) : Kazue IKEDA, et al.

It is certified that error appears in the above-indentified patent and that said Letters Patent is hereby corrected as shown below:

COLUMN 19:

Line 46, "Laying-Open" should read --Laid-Open--;

Line 47, "Laying-Open" should read --Laid-Open--.

COLUMN 20:

Line 17, "shown" should read --shown in--;

Line 18, "in" should be deleted;

Line 39, "passages" (second occurrence) should read --passage--.

UNITED STATES PATENT AND TRADEMARK OFFICE

CERTIFICATE OF CORRECTION

PATENT NO. : 5,182,580

DATED : January 26, 1993

INVENTOR(S) : Kazue Ikeda, et al.

It is certified that error appears in the above-identified patent and that said Letters Patent is hereby corrected as shown below:

Column 22, line 4, "os" should read--of--.

Signed and Sealed this

Twenty-second Day of February, 1994

Bruce Lehman

*Attest:*

BRUCE LEHMAN

*Attesting Officer*

*Commissioner of Patents and Trademarks*